US011326335B2

(12) United States Patent
Casey et al.

(10) Patent No.: US 11,326,335 B2
(45) Date of Patent: May 10, 2022

(54) TANK FOR PRESSURE SEWER INSTALLATION

(71) Applicant: South East Water Corporation, Frankston (AU)

(72) Inventors: Eamon Casey, Frankston (AU); Paul Pastulovic, Frankston (AU)

(73) Assignee: South East Water Corporation, Frankston (AU)

( * ) Notice: Subject to any disclaimer, the term of this patent is extended or adjusted under 35 U.S.C. 154(b) by 0 days.

(21) Appl. No.: 16/623,910

(22) PCT Filed: Jun. 29, 2018

(86) PCT No.: PCT/AU2018/050678

§ 371 (c)(1),
(2) Date: Dec. 18, 2019

(87) PCT Pub. No.: WO2019/000052

PCT Pub. Date: Jan. 3, 2019

(65) Prior Publication Data

US 2021/0148106 A1 May 20, 2021

(30) Foreign Application Priority Data

Jun. 30, 2017 (AU) ..... 2017902555

(51) Int. Cl.
*E03F 5/02* (2006.01)
*E03F 5/22* (2006.01)
*B65D 88/76* (2006.01)

(52) U.S. Cl.
CPC ..... *E03F 5/024* (2013.01); *B65D 88/76* (2013.01); *E03F 5/22* (2013.01); *Y10T 137/6991* (2015.04)

(58) Field of Classification Search
CPC ..... E03F 5/024; B65D 88/76; Y10T 137/6991
USPC ..... 220/567.1, 565, 675; 417/36, 360
See application file for complete search history.

(56) References Cited

U.S. PATENT DOCUMENTS 4,359,167 A 11/1982 Fouss et al.
4,709,723 A 12/1987 Sidaway et al.
4,867,871 A * 9/1989 Bowne ..... C02F 1/006 210/97

(Continued)

FOREIGN PATENT DOCUMENTS

DE 19914008 A1 10/2000
EP 1801035 A1 * 6/2007 ..... B65D 88/06

OTHER PUBLICATIONS

Aug. 30, 2018—International Search Report & Written Opinion of PCT/AU2018/050678.

(Continued)

*Primary Examiner* — Kevin F Murphy
(74) *Attorney, Agent, or Firm* — Banner & Witcoff, Ltd.

(57) ABSTRACT

The present invention relates to a storage tank, comprising a neck portion having an opening, the neck portion having side walls which define a first storage volume; a body portion connected to, and located below, the neck portion, the body portion having side walls and a base which define a second storage volume, wherein a section of the body portion is configured with a substantially rectangular cross-section in the horizontal plane, and wherein the second storage volume is greater than the first storage volume; and ribs projecting generally radially from the side walls of the neck portion and/or the body portion.

17 Claims, 21 Drawing Sheets

(56) References Cited

U.S. PATENT DOCUMENTS

| | | | | |
|---|---|---|---|---|
| 5,816,510 | A | 10/1998 | Earle, III et al. | |
| 5,924,846 | A * | 7/1999 | Arnold, Jr. | E03F 5/22 417/36 |
| 7,735,668 | B2 * | 6/2010 | Richter | B65D 88/027 220/4.21 |
| 8,857,641 | B1 * | 10/2014 | Moore, Jr. | B65D 90/0033 220/4.24 |
| 2005/0035144 | A1 | 2/2005 | Sacchi | |
| 2005/0281679 | A1 * | 12/2005 | Niedermeyer | F04D 15/029 417/36 |

OTHER PUBLICATIONS

Oct. 18, 2019—International Preliminary Report on Patentability of PCT/AU2018/050678.

* cited by examiner

SECTION G-G 131
410
131

152
420
132
416
653
410

P
SECTION N-N
152
Q

SECTION O-O
152
FIG. 17F SIDE VIEW

O
130
N
N
130
130
152
O 678
152
132
654
132
1113
130

653
DETAIL P
DETAIL Q
678
414
132

SECTION A-A

TANK FOR PRESSURE SEWER INSTALLATION

CROSS-REFERENCE TO RELATED APPLICATIONS

This application is a U.S. National Stage application under 35 U.S.C. § 371 of International Application PCT/AU2018/050678, filed Jun. 29, 2018, which claims the benefit of priority to Application AU 2017902555, filed Jun. 30, 2017. Benefit of the filing date of each of these prior applications is hereby claimed. Each of these prior applications is hereby incorporated by reference in its entirety.

TECHNICAL FIELD

Embodiments relate generally to tanks for pressure sewer installations and lids for such tanks. Embodiments also relate to pressure sewer kits including such tanks and lids. Still further embodiments relate to systems and methods for control of pressure sewer installations.

BACKGROUND

Pressure sewer systems involve the use of a fluid reservoir, such as a tank, buried in the ground to receive sewerage from a dwelling or building. Such pressure sewer systems rely on a pump within the fluid reservoir to pump fluid out of the reservoir and into a reticulated sewer system comprising fluid conduits to transport the sewerage to a suitable processing station. Such pressure sewer systems are generally installed in locations where gravity cannot be adequately relied on as the impetus for transporting the waste fluid within the sewer network.

The pressure sewer systems rely on proper functioning of the pump in combination with a float switch or other level sensor to avoid the fluid reservoir becoming too full and overflowing. Where the pump does not operate properly to evacuate the waste fluid from the fluid reservoir, this can lead to an undesirable overflow and/or leakage of sewerage from the fluid reservoir. This overflow can be a very unpleasant experience for the inhabitants of the dwelling and such inhabitants will commonly contact the organisation responsible for maintenance of the sewer system in order to rectify the problem. In such situations, because the organisation responsible for maintenance of the sewerage system learns about the malfunction from the complainants, there can be a delay before appropriate personnel can be dispatched to address the problem and before an appropriate solution is implemented. Not only do such situations result in significant dissatisfaction on the part of the inhabitants that the pressure sewer system is intended to serve, the leakage of the system presents possible public health and safety issues and reflects badly on the organisation responsible for the system's maintenance and proper function.

It is desired to address or ameliorate one or more shortcomings of prior pressure sewer systems, or to at least provide a useful alternative thereto.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

SUMMARY

Some embodiments relate to a pressure sewer tank kit comprising:

a plastic tank body having a closed lower end and an upper end that defines a top opening, the tank body having wall portions that extend from the lower end to the upper end and define a substantially enclosed tank volume that is closed except for at least one fluid inlet and at least one fluid outlet and except for when the top opening is not occluded; and a tank lid arranged to close the top opening comprising a first lid part and a second lid part, wherein the first and second lid parts cooperate to define a lid chamber therebetween and the second lid part is separable from the first lid part when the first lid part occludes the top opening to allow external access to the lid chamber without opening the tank.

The tank lid may be formed of plastic material. The at least one of the tank body or the tank lid may be formed by rotational moulding.

The lid chamber may be sized to receive a pump control unit. The tank kit may further comprise the pump control unit. The tank kit may further comprise a solar panel configured to generate electrical energy sufficient to power a pressure sewer pump and a pump control unit. The tank kit may further comprise a pressure sewer pump.

The tank body may comprise an outwardly bulging section intermediate the upper end and the lower end. The outwardly bulging section may be disposed closer to the lower end than the upper end and may be configured to maximise a fluid volume in the tank body that would fall between upper and lower pump set-points.

Some embodiments relate to a tank lid for a pressure sewer tank, the tank lid comprising:

a first lid part and a second lid part, wherein the first and second lid parts cooperate to define a lid chamber therebetween and the second lid part is separable from the first lid part to allow external access to the lid chamber; and attachment structure to permit attachment of the lid to a tank body to occlude a top opening of the tank body.

The second lid part may comprise an upper-most external surface that is configured to be sloped to one side when the tank lid is positioned on the top opening. The tank lid may further comprise a solar cell array disposed in an upward-facing section of the second lid part. The second lid part may define an electrical conduit aperture to allow passage of an electrical conduit between the lid chamber and an output of the solar cell array.

The lid chamber may be a first lid chamber and the first and second lid parts may cooperate to define a second lid chamber therebetween that is separate from the first lid chamber. At least one of the first lid part and the second lid part may comprise at least one chamber separator extending vertically between the first and second lid parts. The first lid chamber may be sized to receive a pressure sewer pump controller and the second lid chamber may be sized to receive a power supply for a pressure sewer pump. The first lid part may define a plurality of cable passages to allow respective cables to extend from within the lid chamber to within the tank body.

The first lid part may comprise at least one handle portion. The at least one handle portion may project in a direction toward the second lid part. The second lid part may define a respective handle recess for receiving each at least one handle portion. The at least one handle portion may comprise two handle portions.

The first and second lid parts may be formed using plastic. The first and second lid parts may be formed using rotational moulding.

An outer periphery of the second lid part may extend beyond an outer periphery of the first lid part. The first lid part may be arranged to be supported by an upper rim of the tank body to occlude the top opening. When the first lid part is supported on the upper rim, a lower wall of the first lid part may be disposed below a level of the upper rim. When the first lid part is supported on the upper rim and the second lid part is supported on the first lid part, the second lid part may not extend below the upper rim.

Some embodiments relate to a tank body for a pressure sewer system, the tank body comprising:

a closed lower end comprising a tank base;

an upper end that defines a top opening; and side walls extending from the lower end to the upper end and defining a substantially enclosed tank volume, except for at least one fluid inlet, at least one fluid outlet and the top opening;

wherein the side walls define a bulged section intermediate the upper end and the lower end and disposed closer to the lower end than the upper end, the bulged section having a maximum lateral width dimension that is between about 20% and about 50% larger than a maximum lateral width dimension of the upper end.

An inner wall of the bulged section may have a non-circular profile in lateral cross-section. A lateral cross-section of an inner wall of the bulged section may have first and second radii of curvature arranged in alternating fashion. An inner wall of the bulged section may have a rounded square shape in lateral cross-section.

The tank body may have a neck section extending between the upper end and the bulged section, the neck section being tapered outwardly in a direction from the upper end toward the bulged section. An inner wall of the neck section may have a substantially frustoconical shape. The neck section inner wall may be generally concentric and co-axial with the bulged section and the tank base about a longitudinal axis of the tank body. The neck section inner wall may be substantially axi-symmetric about the longitudinal axis but an inner wall of the bulged section is not axi-symmetric about the longitudinal axis.

A combined volumetric capacity of the lower end and the bulged section may be at least 50% greater than a remaining volumetric capacity of the tank body.

The upper end may comprise an annular flange having a raised inner rim that stands proud of a radially outer part of the annular flange. The upper end may comprise a mouth that defines the top opening, wherein the mouth has an inwardly tapered wall that tapers inwardly in a downward direction. The inwardly tapered wall may have a bottom edge extending below the raised inner rim. The inwardly tapered wall may be defined in part by the raised inner rim. The tank body may further comprise a plurality of horizontal and vertical exterior ribs extending outwardly from the side walls to provide increased structural strength to the tank body.

Some embodiments relate to a method of installing a pressure sewer tank, comprising:

positioning a pressure sewer tank body in relation to a ground surface;

positioning a pressure sewer pump in the tank body;

coupling an inlet conduit to an inlet of the tank body and coupling an outlet of the pressure sewer pump to an outlet of the tank body;

positioning a two-part lid over a top opening of the tank body to occlude the top opening, wherein the two-part lid comprises a first lid part to occlude the top opening and a second lid part to cover over the first lid part, and wherein the first and second lid parts define a chamber therebetween that is sized to receive a pump controller.

The method may further comprise positioning the pump controller in the chamber and electrically coupling the pump controller to the pressure sewer pump to allow the pump controller to control operation of the pressure sewer pump.

The chamber of the two-part lid may define a first section to receive the pump controller and a second section spaced from the first section and sized to receive a battery that is configured to supply power to the pump controller and to the pressure sewer pump. The method may further comprise electrically coupling the battery to the pump controller to supply power from the battery to the pump controller. The method may further comprise electrically coupling a renewable energy source to the battery. The renewable energy source may comprise a solar cell array. The solar cell array may be disposed on the second lid part.

The method may further comprise securing the two-part lid to the tank body to substantially close the top opening. The securing may comprise fastening the second lid part to an upper rim of the tank body.

Some embodiments relate to a method of assembling a pressure sewer tank, comprising:

positioning a two-part lid over a top opening of a tank body of the pressure sewer tank to occlude the top opening, wherein the two-part lid comprises a first lid part to occlude the top opening and a second lid part to cover over the first lid part, and wherein the first and second lid parts define a chamber therebetween that is sized to receive a pump controller; and securing the two-part lid to the tank body to substantially close the top opening.

While aspects of the tanks and lids for such tanks will be described below for use in relation to a pressure sewer tank installation system in the preferred embodiments of the present invention, it is to be understood by a skilled person that the tanks and lids for such tanks of the present invention are equally suitable for use in other non-sewage related applications not described herein.

BRIEF DESCRIPTION OF DRAWINGS

Embodiments are described in further detail below, by way of example and with reference to the accompanying drawings, in which:

FIG. 17F is a side view of the upper lid part of FIG. 17A;

DETAILED DESCRIPTION

Embodiments relate generally to tanks for pressure sewer installations and lids for such tanks. Embodiments also relate to pressure sewer kits including such tanks and lids. Still further embodiments relate to systems and methods for control of pressure sewer installations. Some embodiments may employ or be applicable to pressure sewer installations, pressure sewer pump controllers and control methods and systems therefor, which are described in International Patent Application no. PCT/AU2012/000903, filed 31 Jul. 2012, the entire contents of which is hereby incorporated by reference. Some embodiments may also employ or be applicable to pressure sewer installations, pressure sewer pump controllers and control methods and systems therefor, which are described in International Patent Application no. PCT/AU2017/050058, filed 25 Jan. 2017, the entire contents of which is hereby incorporated by reference.

Figure 20:
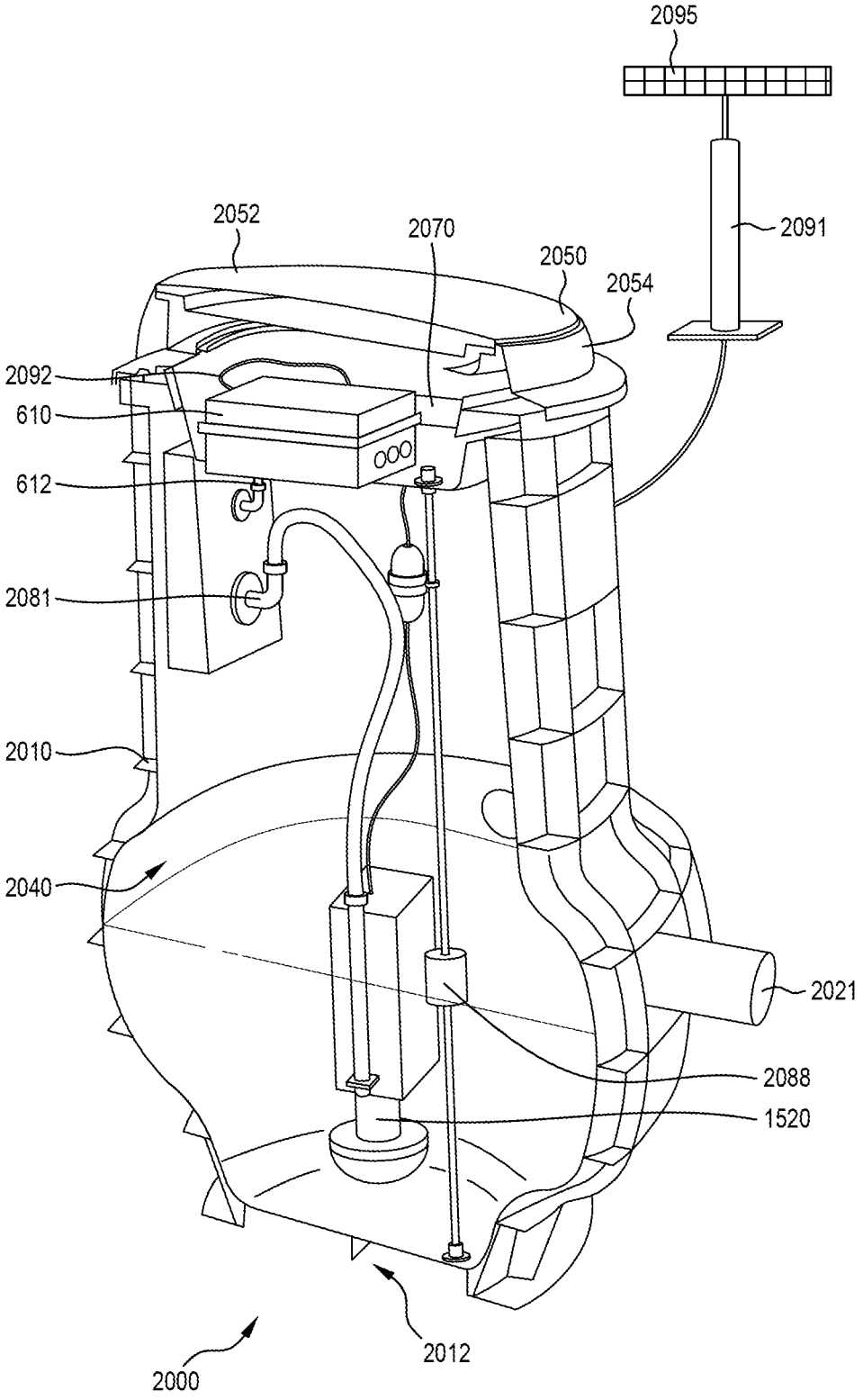
FIG. 20 is a schematic perspective illustration of a pressure sewer tank installation according to some embodiments, shown in cutaway view with a pump, pump controller and level sensor in the tank.

Referring to FIGS. 1A, 1B and 2 to 6, a pressure sewer tank system 100 according to some embodiments is shown and described in detail. The pressure sewer tank system 100 comprises a tank body 110 and a lid 150. The lid 150 is configured to occlude and substantially seal a top opening 125 of the tank body 110. In some embodiments, the pressure sewer tank system 100 may comprise a pump controller 610 (FIG. 6), a power supply 611 (FIG. 21), a pressure sewer pump 2080 (FIG. 20) and one ore more fluid level sensors 2088 (FIG. 20). In some embodiments, the pressure sewer tank system 100 may also comprise a remote server in communication with the pump controller 610, as described in PCT/AU2012/000903. In some embodiments, the tank body 110 and tank lid 150 may form a pressure sewer tank assembly or a part thereof. In some embodiments, the tank body 110 and tank lid 150 may form a kit or part of a kit for a pressure sewer installation, as described in PCT/AU2012/000903. Some embodiments disclosed herein are concerned with the two-part lid for use in described kit, assembly or system embodiments. Further embodiments are concerned with methods of installation of the pressure sewer tank system 100 or installation and/or methods of assembly of the two-part lid 150 to the tank body 110.

The tank body 110 defines an interior volume 140 that is generally closed except for the top opening 125 and one or more fluid inlets 121, 122, 123 formed in a side wall of the tank body 110 in a lower portion 114 thereof.

The tank body 110 has a base or foot 112 that comprises a rim or flange having a bottom edge terminating in a single plane, such that the tank 100 can stand upright vertically while resting the base 112 on one or more support surfaces. The base 112 can rest on a flat upper surface of a transport pallet 102 for transport of the tank 100, for example. The pallet or skid may be a standard pallet, such as an Australian standard pallet, a standard European pallet or a North American pallet, for example.

Figure 1A:
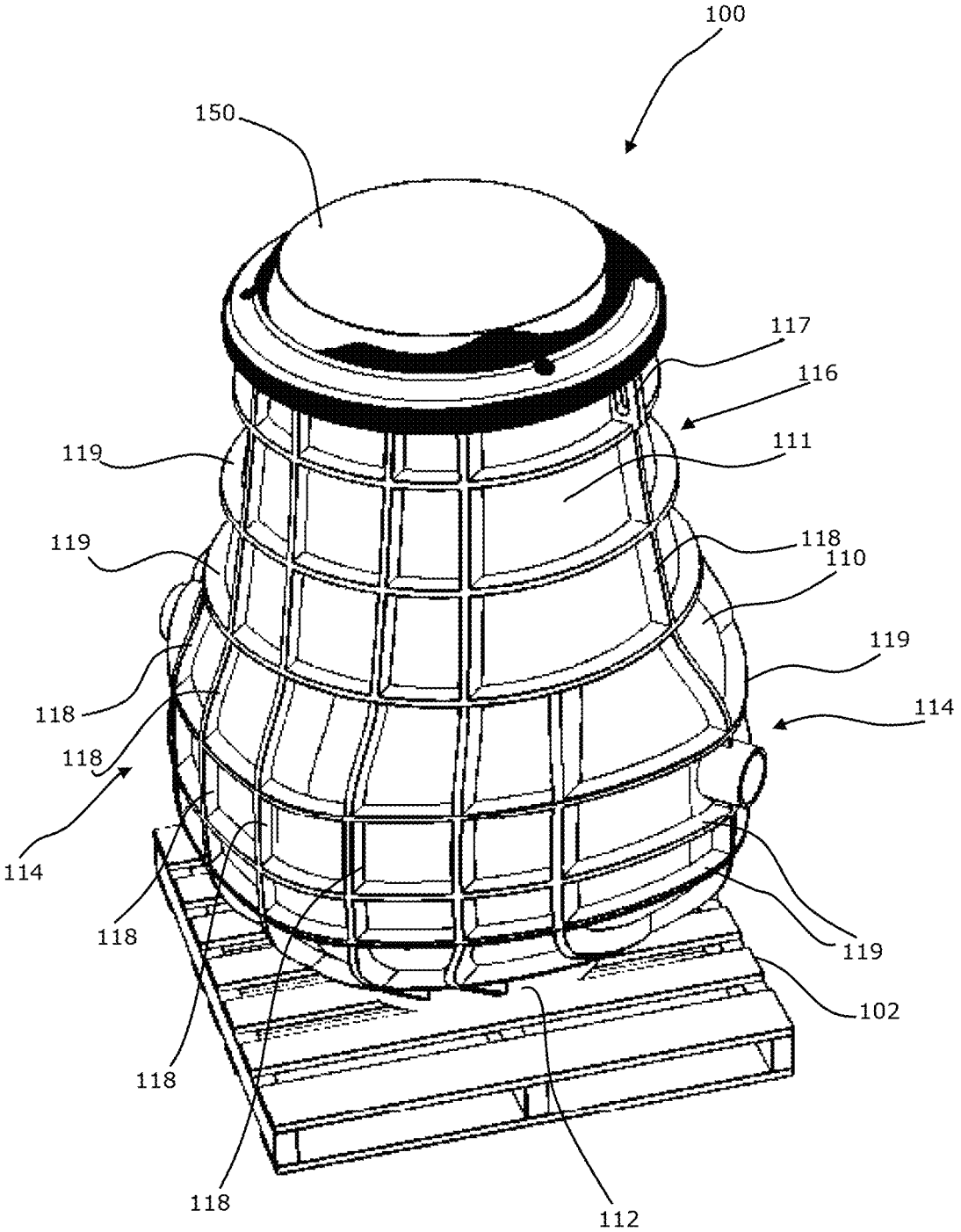
FIG. 1A is a perspective view of a pressure sewer tank according to some embodiments, shown positioned on a standard transport pallet for reference.
Figure 1B:
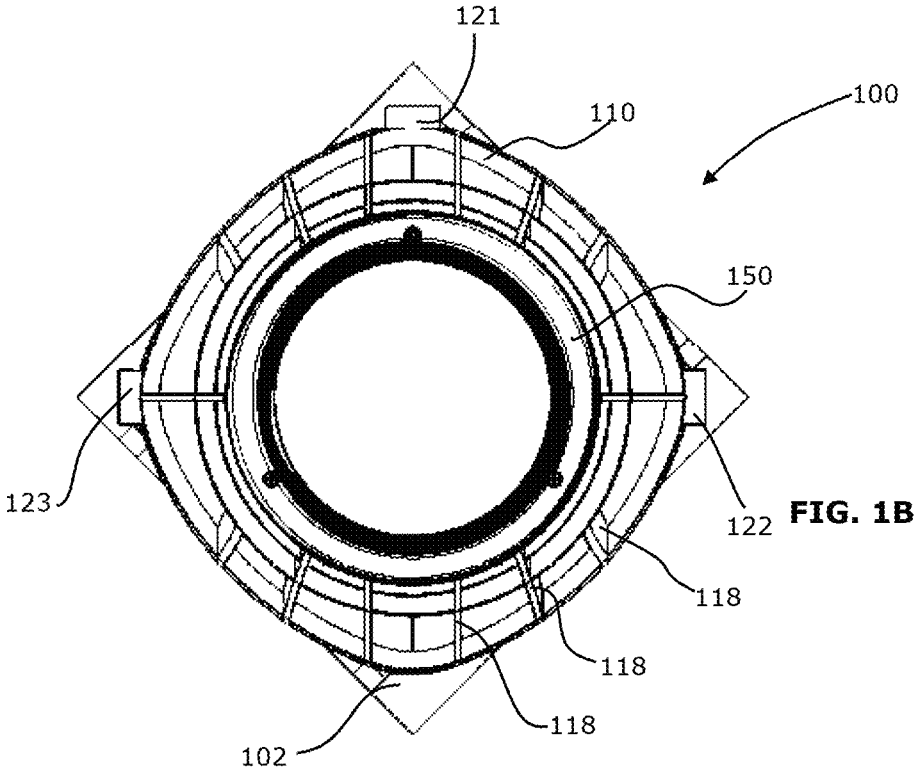
FIG. 1B is a plan view of the tank of FIG. 1A, shown positioned on a standard transport pallet for reference.
Figure 2:
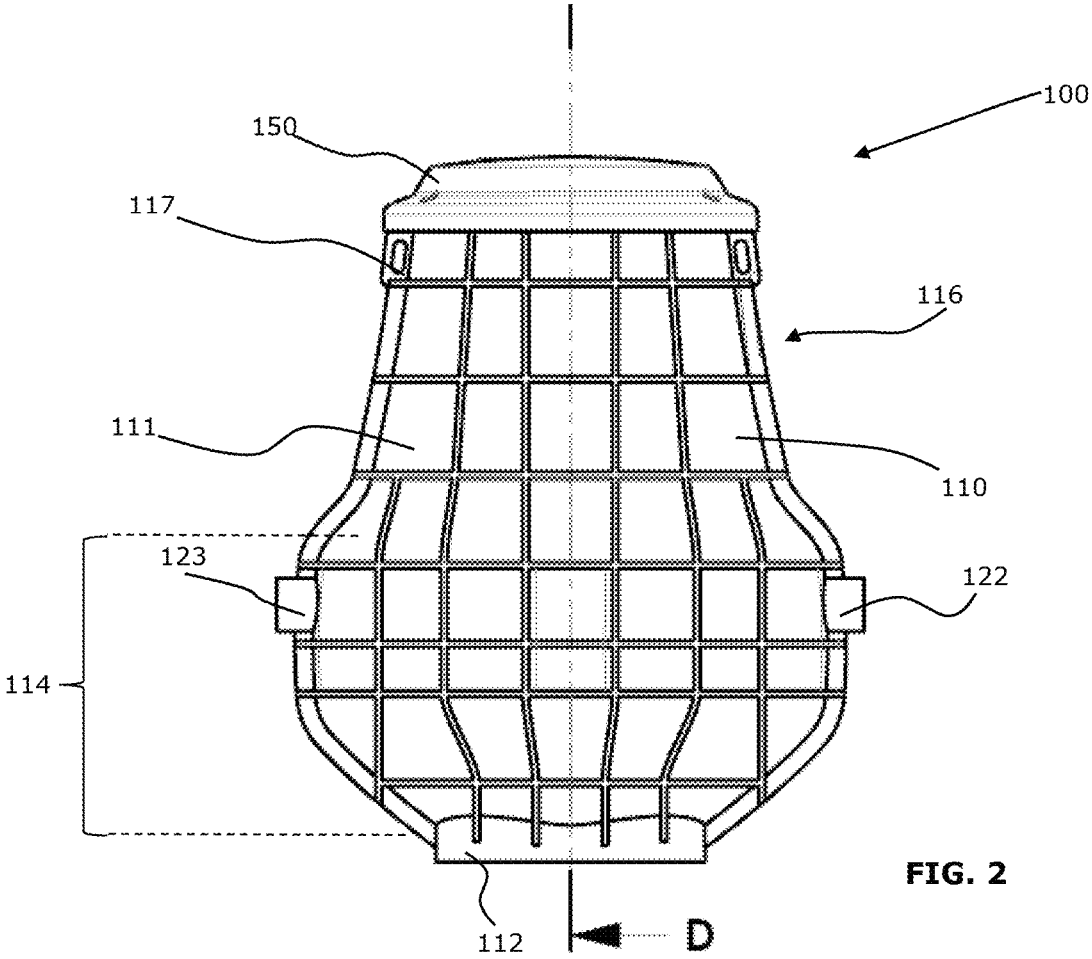
FIG. 2 is a side view of the tank of FIG. 1A.

The lower section 114 of the tank body 110 is generally bulged radially outwardly (or otherwise enlarged in cross-section) to give the tank body 110 a shape approximating a pear. Although the lower section 114 is generally rounded about a circumference of the tank body 110, it may not be circular. Rather, the rounded circumference may be somewhat squared in order to have a profile in plan view (as seen in FIG. 1B) that approximates that of a square pallet, such as pallet 102, while also being rounded across the corners and sides of the somewhat squared profile. Such a rounded squarish profile is sometimes referred to as "squond." This profile in plan view of the tank body 110 allows the benefits of a rounded tank shape while also allowing the benefits of having a squarish profile for ease and efficiency of palletised transport from a tank manufacturing facility to intermediate storage and/or to a site at which the tank is to be installed in the ground.

The tank body 110 has an upper section 116 that has a substantially circular profile that tapers outwardly in the direction from the top of the tank 100 towards the bottom. The taper may be at a shallow angle (i.e. less than 25 degrees, for example around 15 degrees) from the vertical. The upper section 116 may therefore have a somewhat frustoconical shape. Where the upper section 116 meets the beginning of the lower section 114, the outwardly tapering circular profile of the upper section 116 of the tank body 110 transitions into the somewhat squared and rounded profile of the lower section 114.

In some embodiments, three fluid inlets 121, 122, 123 are formed in the wall of the tank body 110 at circumferentially spaced positions around a bulged middle section 142 (FIG. 7A), which forms part of the lower section 114. In other embodiments, there may be only two fluid inlets 121, 122 formed at circumferentially spaced locations around the wall of the tank body 110 in the bulged middle section 142. In other embodiments, there may be only a single fluid inlet 121 formed in the wall of the tank body 110 at a location in the bulged middle section 142. The tank body 110 may be manufactured with the three inlets 121, 122, 123 blinded (blocked, sealed or otherwise occluded) such that a selected one, two or three of them can be opened (e.g. by cutting a hole in wall 115), depending on the desired operational configuration of the tank system 100. For example, in some embodiments, the tank system may be shared by multiple households, with effluent being receivable simultaneously at two or possibly three different inlets 121, 122, 123 from different effluent sources. Use of a single pressure sewer tank system 100 for multiple households reduces the overall cost to install and provide the pressure sewer service and allows for increased efficiency of operation, particularly where the pump controller 610 (FIG. 6) is remotely controllable by a centralised server as described in PCT/AU2012/000903. The tank body 110 may provide only one fluid outlet to the sewerage network.

The tank body 110 may be formed by rotational moulding, for example, using suitable plastics materials. For example, polyethylene, polyvinyl chloride (PVC) plastisols, nylon, polypropylene, and polycarbonate materials may be used for rotational moulding of the tank body 110. Suitable kinds of polyethylene include low density polyethylene (LDPE), cross-linked polyethylene (PEX), linear low density polyethylene (LLDPE), high-density polyethylene (HDPE), for example. As part of the rotational moulding process, the tank body 110 can be formed to have a series of ribs projecting outwardly from the external wall surfaces 111 of the tank body 110. Such ribs can include generally vertically extending ribs 118 and generally horizontally extending ribs 119. These ribs 118, 119 can serve to strengthen the walls of the tank body 110 against inward and outward deformation. The ribs 118, 119 can also serve to strengthen the tank body 110 against top-load deformation.

Ribs 118, 119 may project outwardly from the outer wall 111 by about 30 to about 60 mm, optionally about 45 mm. The depth of ribs 118 may be different from the depth of ribs 119 or they may be the same depth. The vertically extending ribs 118 may extend at circumferentially spaced positions along the outer wall 111 from around the top rim 129 of the tank body 110 to the base 112. The horizontally extending ribs 119 may extend around the circumference of the tank body 110 at vertically spaced positions. One or more of the ribs 118, 119 may be interrupted by one of the fluid inlets 121, 122, 123.

Ribs 118, 119 may effectively act as outer strengthening walls that project outwardly from outer wall 111. Outer wall 111 may be formed as one piece, integrally formed with ribs 118, 119, inlets 121, 122, 123, outlet 124 and upper rim 129. In other embodiments, outer wall 111 may be formed from more than one piece, with each piece being sealingly coupled to another of the pieces in order to form a substantially sealed tank chamber suitable for pressure sewer purposes. Whether formed as one piece or from multiple pieces, outer wall 111 may be considered to define different tank or wall sections as described herein. Outer wall 111 may form all or part of the same wall as inner wall 115, but are distinct from any walls provided by ribs 118, 119, for example.

With reference to FIGS. 9, 23 to 26, upper handles 117A may be formed and located circumferentially towards the top rim 129 of the tank body 110. These handles 117A may be formed in the moulding process or may be formed subsequent to the moulding process, for example by cutting or otherwise removing some plastic material, to define an opening that allows the adjacent plastic material to be readily gripped and used as the handle 117A. In one embodiment, lower handles 117B may also be formed and located circumferentially at the bottom section 141 of the tank body to assist with ease of handling and transportation of the tank body 110. In particular, the lower handles 117B may be positioned in the bottom section 141 of the tank body which tapers towards the base 112. The upper and lower handles 117 may be positioned such that up to three persons may lift and carry the tank body.

The tank 100 may have an approximate height of about 1.5 to 2 metres, optionally about 1.6 to 1.9 metres, or optionally about 1.7 to 1.8 metres, for example, measured from the bottom of base 112 to the top of the lid 150. A maximum lateral width of the tank body 110 may be in the range of about 1.2 to about 1.8 metres, optionally 1.3 to 1.6 metres, or optionally about 1.4 to 1.5 metres, for example.

This maximum lateral width may be at or near the position of the fluid inlets 122, 123 within the lower section 114. The fluid inlets 121, 122, 123 project outwardly from the tank outer wall 111 by around 70 to around 100 mm, optionally around 90 mm. The fluid inlets 121, 122, 123 may therefore project outwardly beyond (proud of) vertical and/or horizontal ribs 118, 119 by around 30 to around 60 mm, optionally around 45 mm.

The bulged or bulbous pear shape of the tank body 110 is advantageous for pressure sewer installations that have an intelligent pump controller associated therewith, where such a pump controller is responsive to control commands from a remote server to adjust the timing or set points used for pumping out the contents of the tank. Examples of such pressure sewer installations are described in International Patent Application no. PCT/AU2012/000903, and International Patent Application no. PCT/AU2017/050058. Such advantages can arise because the design of the tank body 110 (shown in FIG. 3, for example) gives a significantly greater fluid volume in the lower section 114 of the tank body 110 while allowing the upper section 116 (in which some significant head space is desirable) to contain relatively little fluid volume during normal operation.

Figure 6:
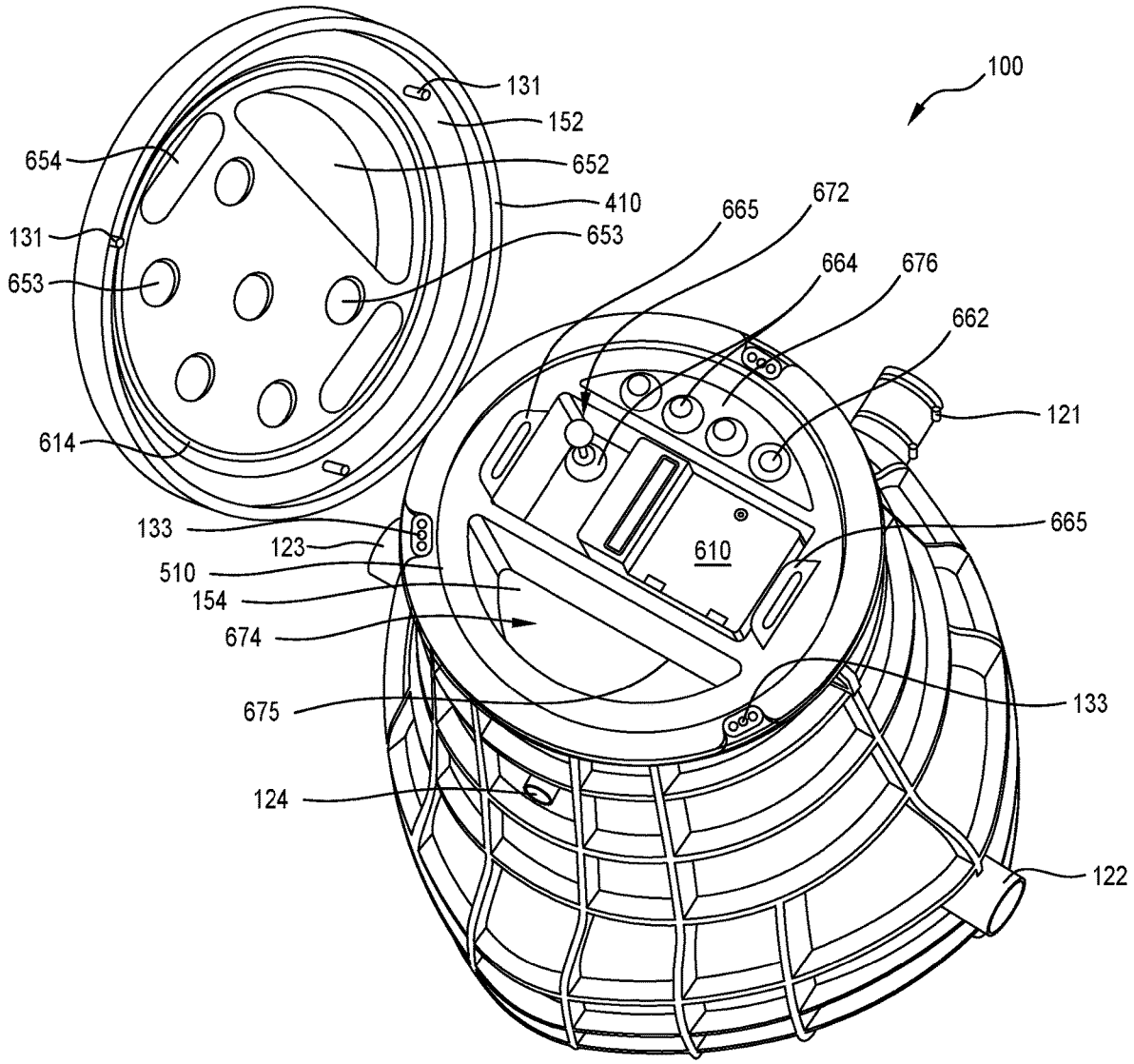
FIG. 6 is a top respective view of the tank of FIG. 1A, shown with an upper part of the lid removed and a lower part of the lid remaining in place on top of the tank body.

It is desirable to keep the head space of the tank volume 140 relatively free of fluid in order to avoid triggering the high fluid level sensor alarms too frequently. This apportioning of the fluid storage to be maximised towards the lower section 114 allows the pump controller to have access to maximum fluid volumes in order to best utilise the intelligent control functions that come with remote server control of the pump controller 610 (FIG. 6). Such functions may include, for example, remote-controlled peak-shifting of pumped fluid volumes from many tanks in the same sewerage zone into the sewerage network (i.e. to smooth peak loads and avoid all or many tanks in the same zone pumping into the network at or around the same time); or forced flushing or scouring a part of the sewerage pipe network nearby by intentionally emptying a number of tanks into the network simultaneously. If a remote server controlled pump controller is not utilised by the pressure sewer installation, then the maximisation of the fluid volume in the tank in the lower section 114 may be irrelevant.

Figure 7A:
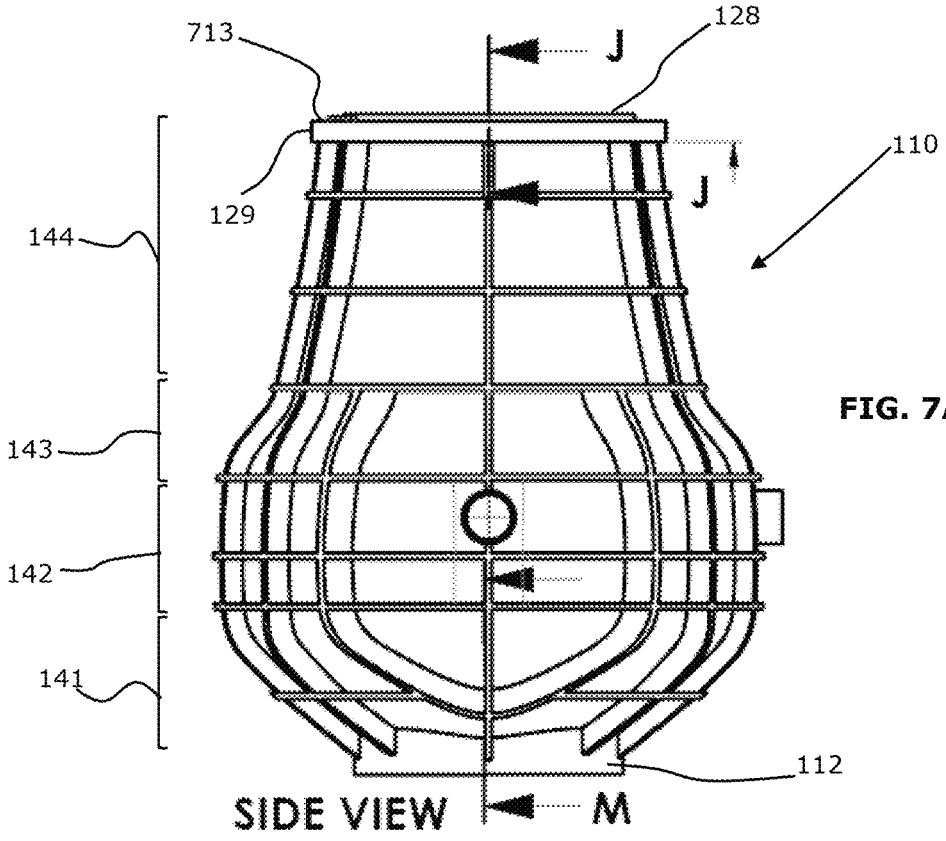
FIG. 7A is a side view of the tank of FIG. 1A showing the tank body without the lid.
Figure 7B:
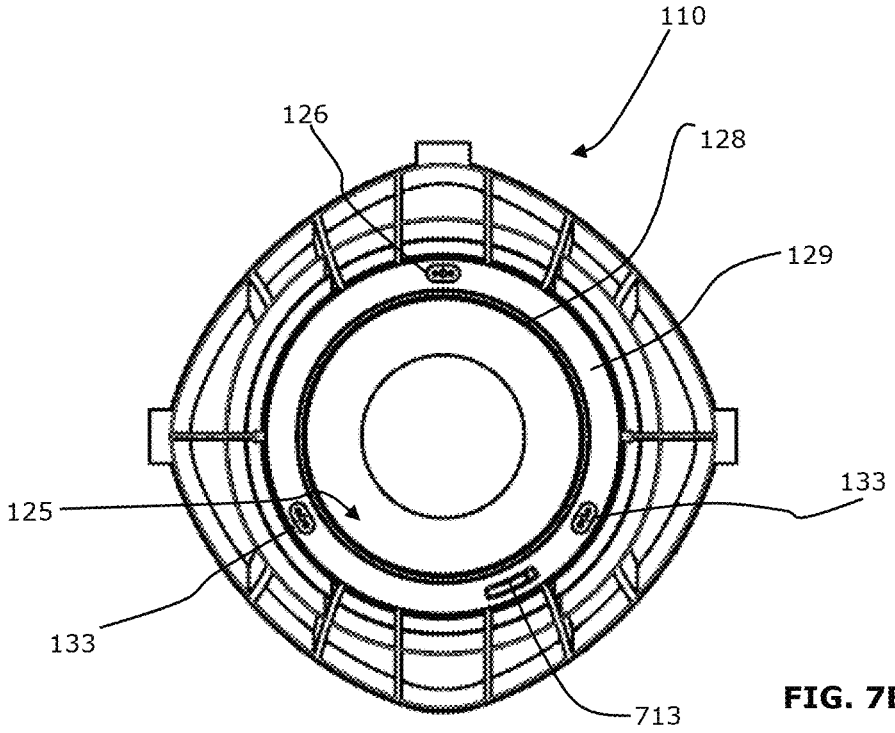
FIG. 7B is a plan view of the tank body shown in FIG. 7A.

Further advantages associated with the shape of the tank body 110 reside in the balance of factors including: providing a large cross-sectional area (in plan view as seen in FIGS. 1B and 7B) while still allowing for the tank body 110 to be transportable using a pallet or skid; providing a large volume to accommodate fluid below the inlet level (i.e. of one or more inlets 121, 122, 123); providing a small dead space volume at the tank bottom section 141 to minimise odours from stagnant effluent; providing a tank wall that is steep enough to minimise the amount of settlement of particulates from the received effluent; and configuring the dimensions of the bottom section 141 and base wall 112*a* to allow optimised pump performance with respect to minimising entrainment of sludge or heavy particulates in fluid drawing into the pump from near the base wall 112*a*. In addition, the shape of the tank body 110 advantageously provides improved anchoring of the tank when buried underground. The tapered neck section (top section 144) advantageously allows a greater volume of earth to be seated above the bulged or bulbous shape of the lower sections 141-143 of the tank body 110 so as to reduce sideway and/or upward displacement of the tank by movements of the earth over time. Moreover, the vertical and horizontal ribs 118, 119 further anchors the tank body 110 in the earth when buried and limits the propensity of tank displacement over time.

Base 112 may be formed to include at least one an annular rim or ring that extends vertically downwardly from an inner base wall 112*a* in order to provide a stable support structure to support to weight of the tank body 110 and its contents. In some embodiments, the annular rim or ring may include multiple concentric rims or rings that extend downwardly to provide additional support structure. The base 112 may therefore include an outer annular rim or ring and at least one inner annular rim or ring. The at least one annular rim or ring can possibly include some circumferential interruptions without the structural support function of the base 112 being too diminished. The lower extent of the at least one annular rim or ring defines a support plane that is intended to substantially horizontal in normal use and is generally perpendicular to the longitudinal (vertical) axis of the tank body 110. In further embodiments, one or more non-annular crossing ribs 118*a* may be formed inside the annular rim or ring to provide strengthening structural support to the base wall 112*a*. Inner base wall 112*a* acts as a bottom wall of the fluid-receiving chamber defines by the tank body 110. Inner base wall 112*a* may be substantially flat or may have a slight convex or concave shape to it.

Figure 10:
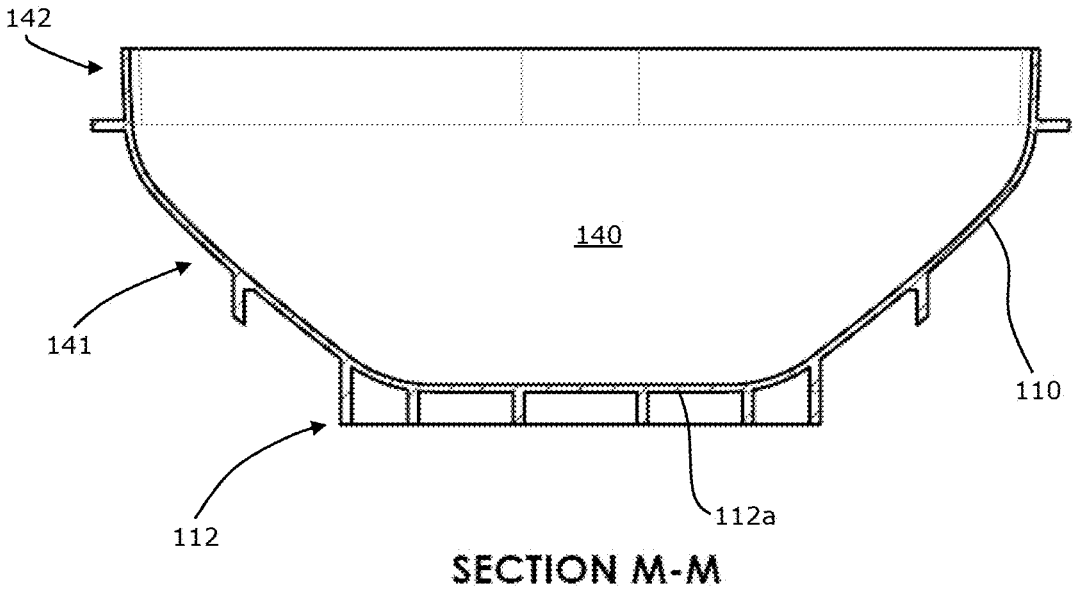
FIG. 10 is a partial cross-sectional view of a bottom part of the tank body, taken along line M-M shown in FIG. 7A.
Figure 11:
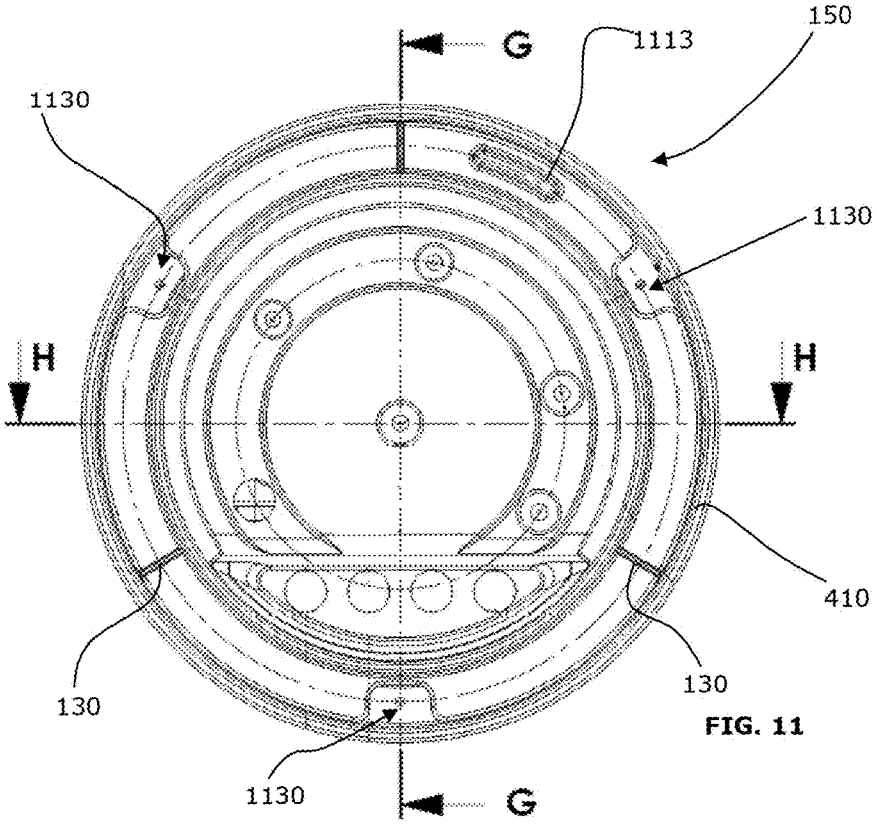
FIG. 11 is a plan view of a lid assembly making up the tank lid, with interior features shown as if the top of the lid were transparent.

As shown in FIG. 10, a flat section of the inner base wall 112*a* may have a dimeter of around 400 mm, for example. The annular rim or ring may have a dimeter of around 660 mm, for example. The support structure for the base 112 therefore extends radially beyond the flat base wall 112*a*. The diameter of the inner wall 115 of the second middle section 142 may be about twice or 5-10% less than twice the diameter of the annular rim or ring of base 112, for example. The diameter of the inner wall 115 of the second middle section 142 may be about 1240 mm, for example.

The pump 2080 (FIG. 20) may be arranged to rest on and be supported by the flat base wall 112*a* without being attached to the base wall 112*a*. The pump 2080 may have or rest on a foot portion or pump support base that serves to elevate a fluid intake of the pump 2080 at a distance above the base wall 112*a* that is sufficient to minimise or avoid intake of heavy particulate matter that may have accumulated in the bottom of the tank volume 140.

Figure 4:
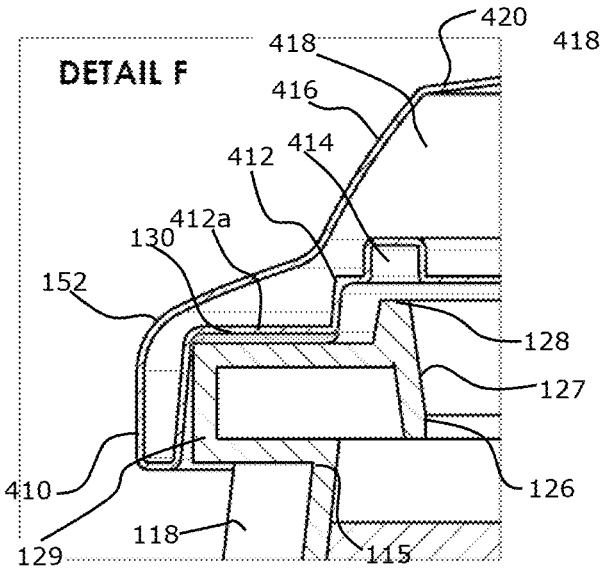
FIG. 4 is a close up view of a part of the lid of the tank marked as detail F in FIG. 3.
Figure 5:
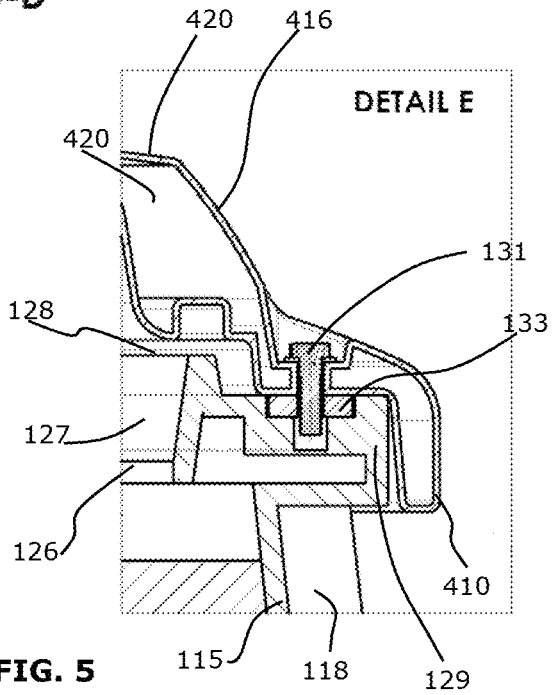
FIG. 5 is a close up view of a part of the lid of the tank marked as detail E in FIG. 3.

FIGS. 4 and 5 show detailed views of parts of the upper lid part 152 in position over the top opening 125 and upper rim 129 of the tank body 110. In the detailed views of FIGS. 4 and 5, the lower part 154 of the lid 150 is omitted, but details of the lower part 154 are shown and described in further detail in relation to FIGS. 11 to 16. The upper lid part 152 comprises a top wall 416 that is to be exposed to the outside environment and includes a top section 420 that is either generally flat or slightly convex shaped and may be sloped (angled) to one side. Sloping the top section 420 to one side promotes water, debris or other detritus to tend to slide off to the side and not collect on top of the upper lid part 152.

The top wall 416 generally defines a more steeply (downwardly) angled section circumferentially around the top section 420 that then transitions into a more shallowly angled outwardly tapering apron section that generally overlies the top rim 129 of the tank body 110. From the tapering apron section, the top wall 416 extends outwardly and then downwardly to define a flanged or overhanging portion 410. The flanged section 410 has a generally annular form and is sized and configured to substantially cover an outer flanged rim 510 (FIG. 16) of the lower lid part 154 and to also substantially cover the top and side sections of the top rim 129.

The upper lid part 152 may be formed to be substantially hollow or at least somewhat hollow, thereby defining at least one cavity 418 between the top wall 416 and an inner wall 412. The inner wall 412 defines a receiving recess 414 for a sealing ring (415). The sealing ring is arranged to abut and seal against a raised rim 128 positioned at a radially inner part of the top rim 129. An inner annular section 412*a* of the inner wall 412 is disposed radially between the receiving recess 414 and the flanged section 410. The inner annular section 412*a* is arranged to be generally horizontal when the upper lid part 152 is in place and overlies a flattened section 130 of the top rim 129 that is intended to support the outer rim 510 of the lower lid part 154.

As shown in FIG. 5, the upper lid part 152 defines at least one (and preferably multiple) connection structures to facilitate connecting the upper lid part 152 to the upper rim 129, for example in the form upper lid apertures to receive fasteners 131. The fasteners 131 extend through the upper lid apertures and into an anchor portion 133 disposed in the top rim 129. The fasteners 131 may be or include threaded bolts, for example. The anchor portion 133 may be formed integrally with the top rim 129 or may include a separate anchor plate that is connected to the top rim 129.

The top opening 125 is defined by an inner area of the top rim 129. The inner area comprises the raised rim 128 and an inwardly angled sloping wall 127 that has a chamfered inner edge 126. The sloping wall 127 slopes inwardly in a downward direction at an angle of around 10 degrees to around 20 degrees. This inward slope defined by sloping wall 127 assists in locating and seating the lower lid part 154 in the top opening 125.

Figure 9:
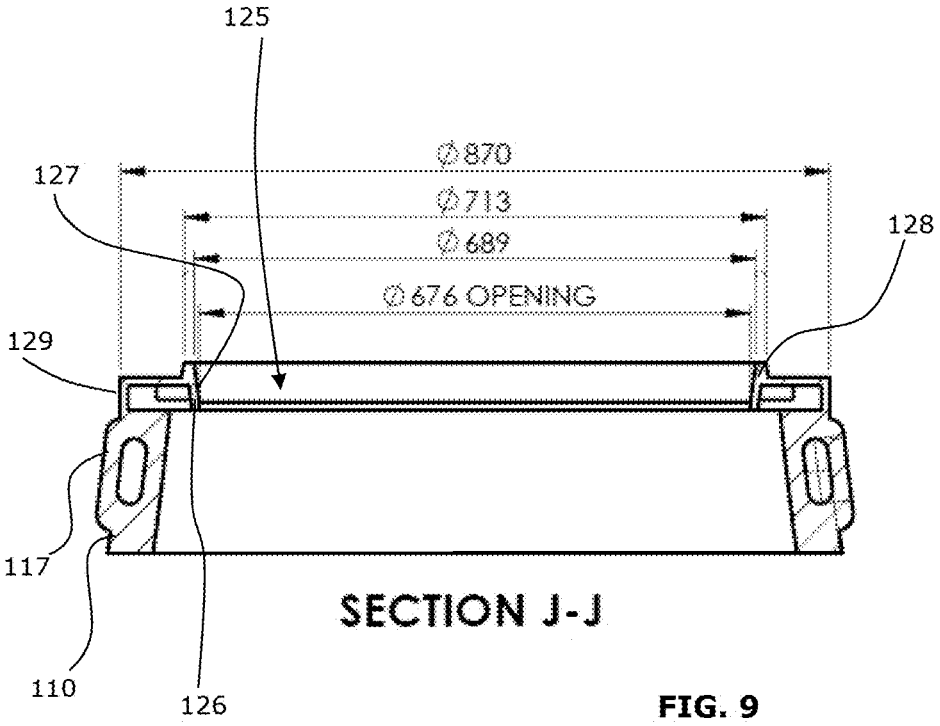
FIG. 9 is a partial cross-sectional view of a top rim of the tank body, taken along section line J-J shown in FIG. 7A.
Figure 26:
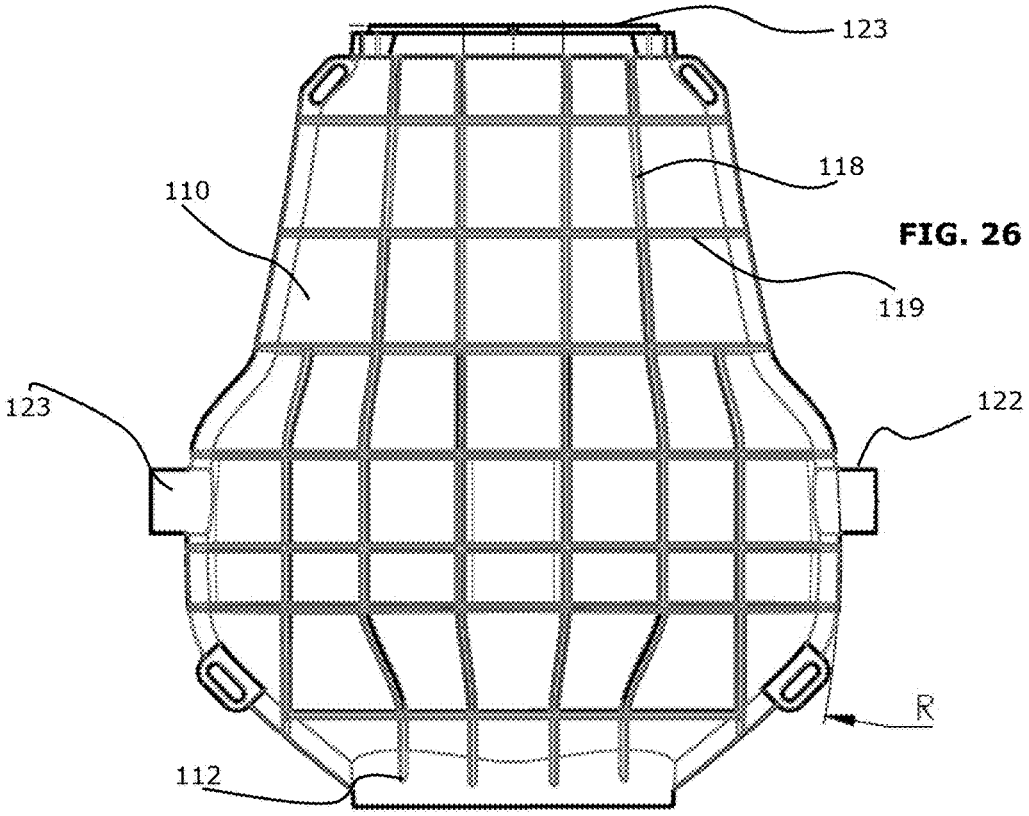
FIG. 26 is a front view of the pressure sewer tank of FIG. 23 without the lid component.
Figure 27:
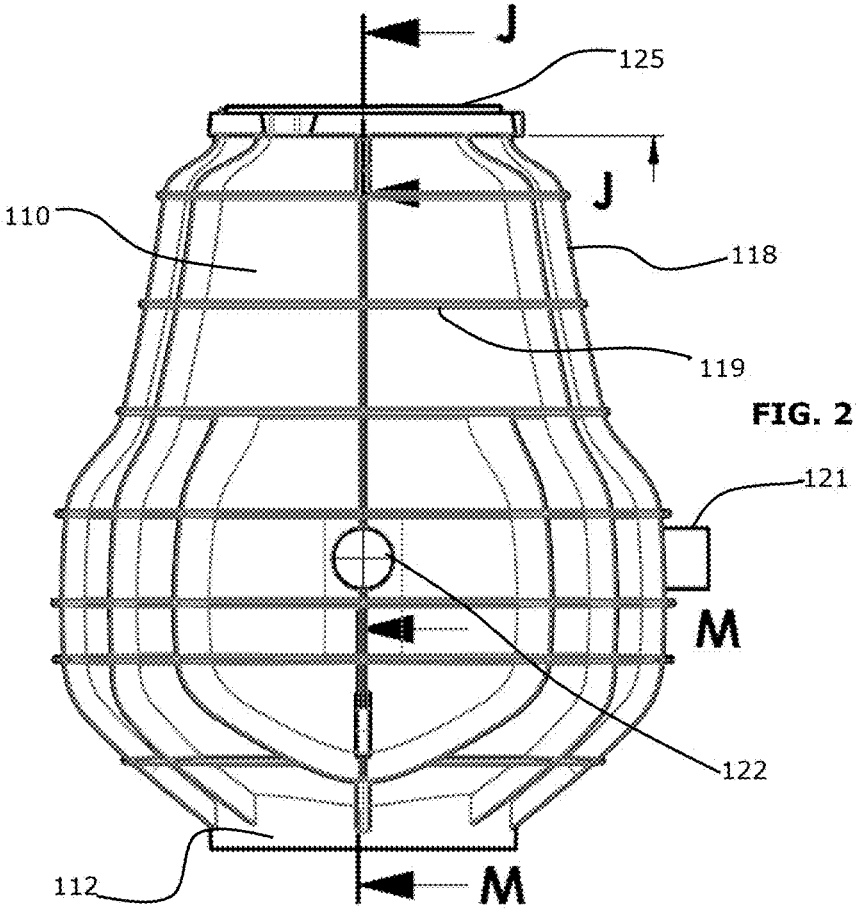
FIG. 27 is a side view of the pressure sewer tank of FIG. 23 without the lid component.
Figure 28:
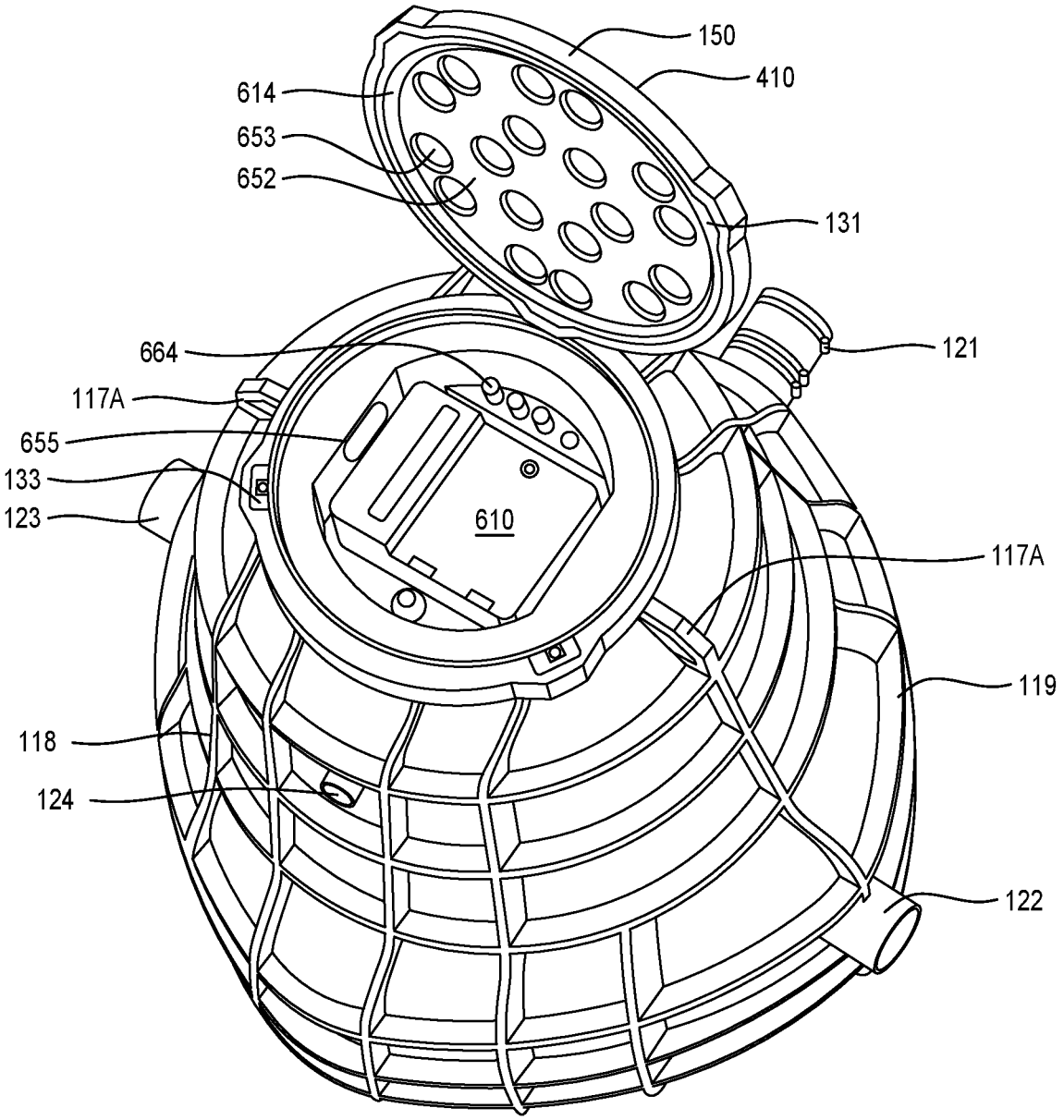
FIG. 28 is a top perspective view of the pressure sewer tank assembly of FIG. 23, showing the lid assembly in an opened position.
Figure 29:
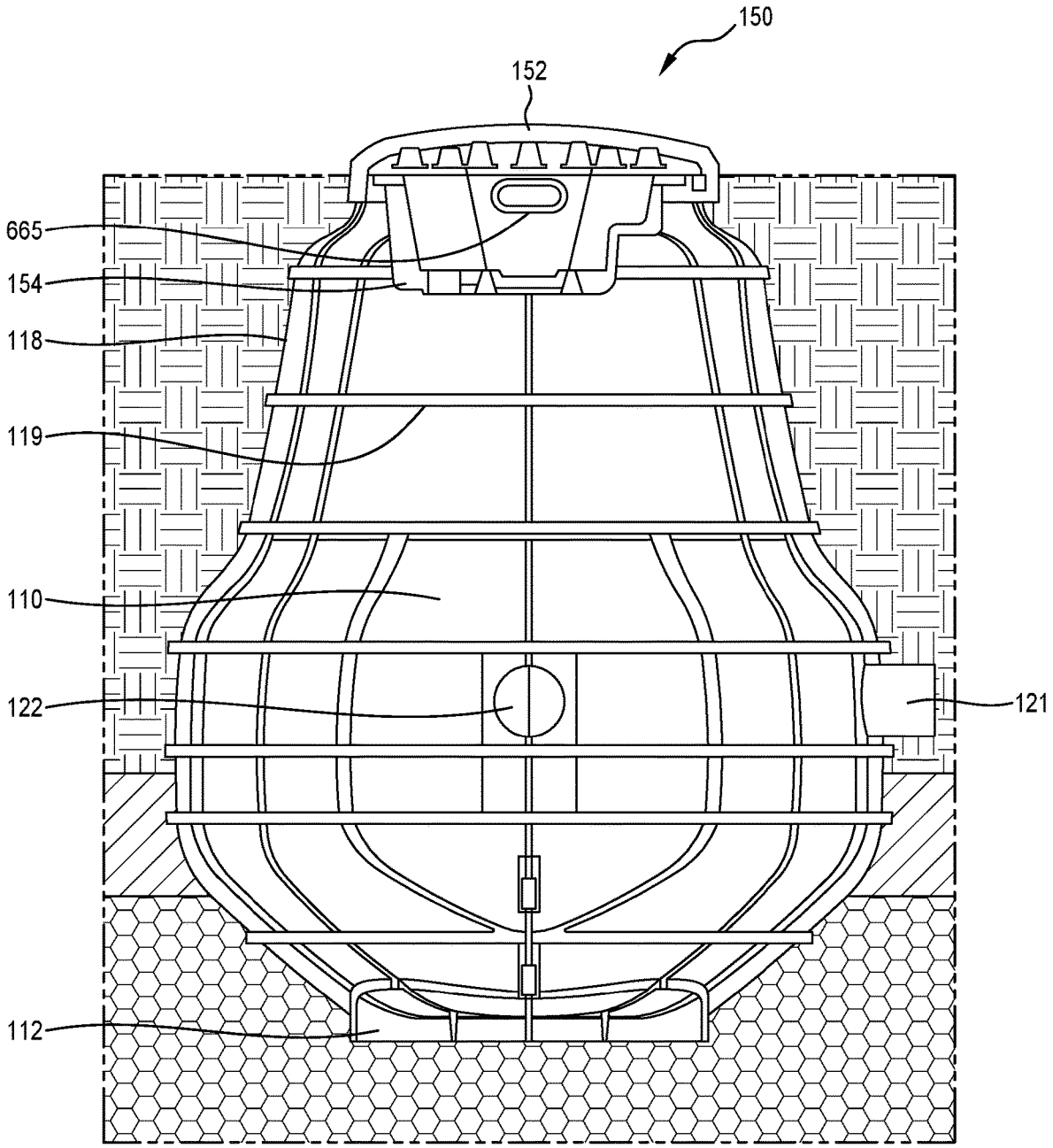
FIG. 29 is a sectional view of the pressure sewer tank assembly of FIG. 23.
Figure 30:
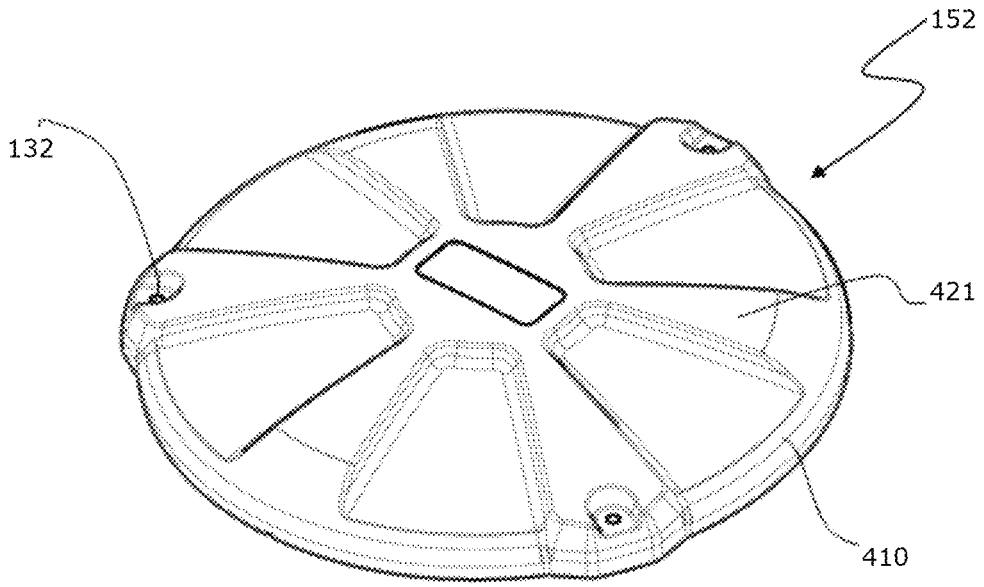
FIG. 30 is a perspective view of a lid of the pressure sewer tank assembly in accordance with an embodiment of the present invention.
Figure 31:
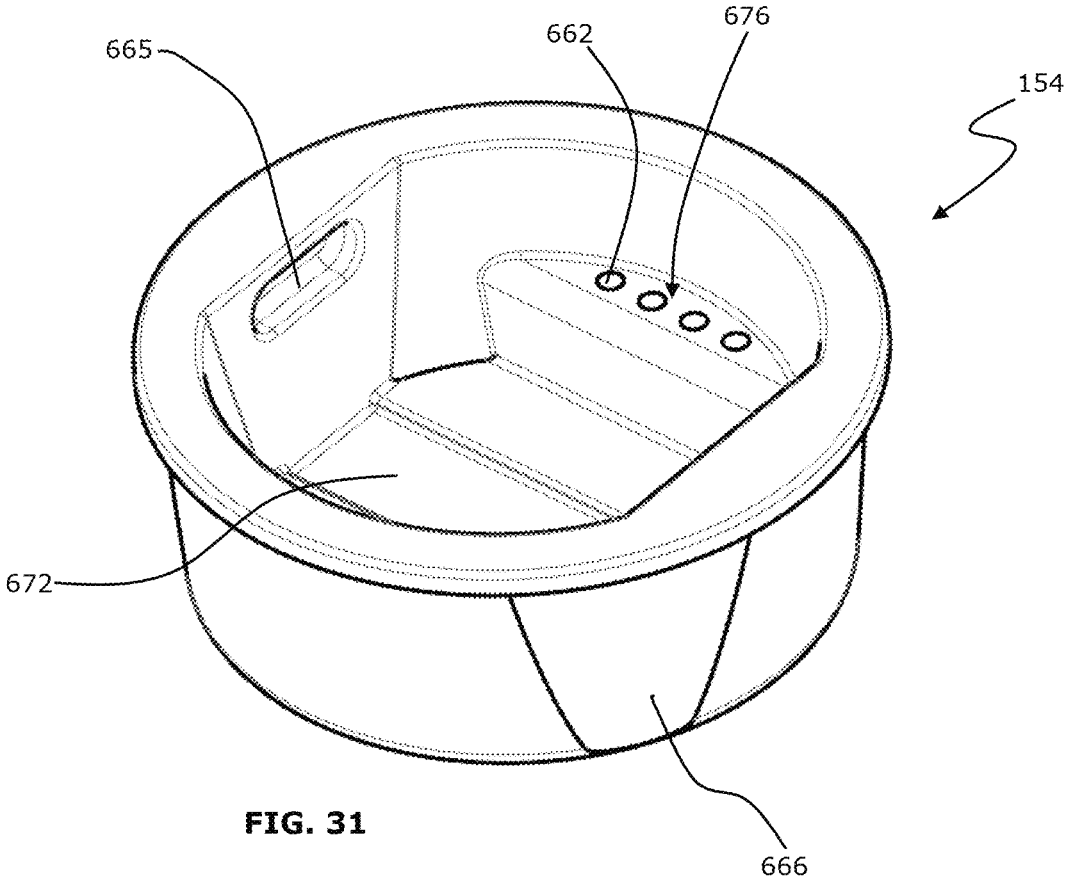
FIG. 31 is a perspective view of a lid enclosure of the pressure sewer tank assembly in accordance with an embodiment of the present invention.

As shown in FIG. 9, the outer extent of the top rim 129 may have a diameter of around 870 mm, for example. The raised rim 128 may have a diameter of around 710 mm, for example. The diameter of the top opening 125 (as defined by the inner chamfered edge 126) may be around 675 mm, for example. In another embodiment, as shown in FIGS. 26 and 27, the top rim 129 may have a reduced diameter of around 720 mm, the raised rim 128 may have a diameter of around 660 mm and the diameter of the top opening 124 may be around 540 mm.

FIG. 7A is a side elevation view of the tank body 110 without the lid 150 thereon. As seen in FIG. 7A, the tank body 110 may be notionally divided into four vertical sections. The four sections may be contiguous. The top section 144 corresponds to the upper section 116 where the wall of the tank body 110 is generally outwardly tapering in a downward direction and has an approximately circular inner wall profile in lateral cross-section. A first middle section 143 may be positioned below the top section 144 and provides an outwardly tapering transition section that has a shallower (i.e., more horizontal) angle than the top portion 144. The first middle section 143 may be angled outwardly at between about 30 degrees to about 60 degrees to the vertical. The first middle section 143 serves to transition the contours of the tank body 110 from a round profile to the more square profile that is present in the widest parts of the bottom section 114. The second middle section 142 is positioned below the first middle section 143 and has the generally rounded square appearance in plan view, as described previously and shown in FIG. 7B, but having generally vertical outer walls 111 (excluding horizontal ribs 119). The one or more fluid inlets 121, 122, 123 are preferably positioned toward a top part of the second middle portion 142 to maximise the part of the tank volume 140 that is below the inlet level, to thereby avoid or minimise flooding of the one or more inlets 121, 122, 123 during normal operating conditions.

In one embodiment, the neck section (top portion 144) of the tank body 110 may be configured to taper inwardly toward a lid assembly 150 of a reduced diameter as shown in FIGS. 23 to 31. For example, a top portion of the neck section 144 has its diameter reduced evenly towards the top rim 129 of the top opening 125. This configuration effectively creates a smaller opening and accommodates a lid assembly having a reduced diameter.

Figure 3:
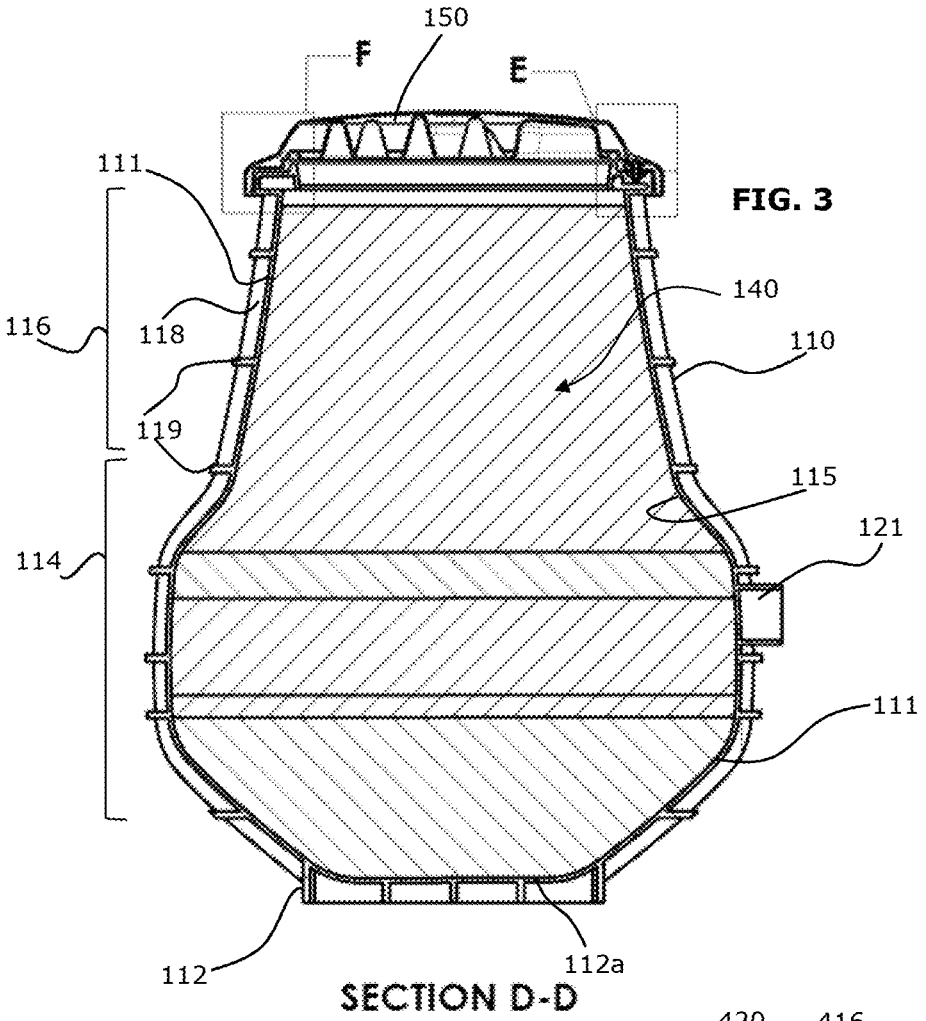
FIG. 3 is a cross-sectional view of the tank shown in FIG. 2, taken along line D-D of FIG. 2.

Below the second middle section 142 is a bottom section 141 that tapers inwardly toward the base 112 in the downward direction. The bottom section 141 serves to taper and transition the rounded square profile of the second middle section 142 into a generally rounded shallow bottom wall 112*b*, as best seen in FIG. 3.

The bottom section 141 is tapered inwardly toward the bottom wall 112*a* such that, once a pump is installed onto the bottom wall 112*a*, a "dead space" volume is defined so that a minimum fluid and/or sediment volume can be retained in the bottom of the tank body 110. This dead space volume can accommodate an amount of heavy sediment that might cause damage to the pump if it were to be sucked into the pump during use. The inward taper of the bottom section 141 toward the bottom wall 112*a* may be tapered at an angle of around 40 to 50 degrees to the vertical, for example. The volume of dead space at the bottom of the tank volume 140 depends on the tank shape and the pump cut out level of the particular pump installed. In one example, for a pressure sewer pump provided by Environment One Corporation, the cut out level is about 350 mm above the base wall 112*a*, which results in a dead space having a volume of about 231 Litres.

In some embodiments, the bottom section 141 may have a volumetric capacity (without a pump being present) of around 230 litres, for example. The second middle section 142 may have a volumetric capacity of around 390 litres, for example. The first middle section 143 may have a volumetric capacity of around 100 to 115 litres, for example. The top section 144 may have a volumetric capacity of around 440 to about 460 litres, for example. A combined volumetric capacity of the lower end (bottom section 141) and the bulged section (i.e. middle sections 143, 142) is at least 50% greater than a remaining volumetric capacity of the tank body (i.e. top section 144). However, the proportion of the height of the tank body 110 taken up by the top section 144 is in the range of 40-50% of the total height of the tank body 110.

The inner wall 115 of the bulged section (i.e. the second middle section) may have a non-circular profile in lateral cross-section. The lateral cross-section of the inner wall 115 of the bulged section has first and second radii of curvature arranged in alternating fashion. In other words, the inner wall 115 of the bulged section may have a rounded square shape in lateral cross-section.

The tank body 110 effectively has a neck section (top section 144) extending between the upper end (generally defined by the area around top rim 129) and the bulged section (middle sections 143, 142), the neck section being tapered outwardly in a direction from the upper end toward the bulged section. The inner wall 115 of the neck section has a substantially frustoconical shape.

The neck section inner wall 115 is generally concentric and co-axial with the bulged section (middle sections 143, 142) and the tank base 112 about a longitudinal axis of the tank body110. Further, the neck section inner wall 115 is substantially axi-symmetric about the longitudinal axis but an inner wall of the bulged section is not axi-symmetric about the longitudinal axis. This non-axi-symmetry in the bulged section is because it has varying radii of curvature about the circumference of the bulged section and because of the presence of the inlets 121, 122, 123 at three circumferentially spaced locations (eg. 0, 90 and 180 degrees).

Figure 8A:
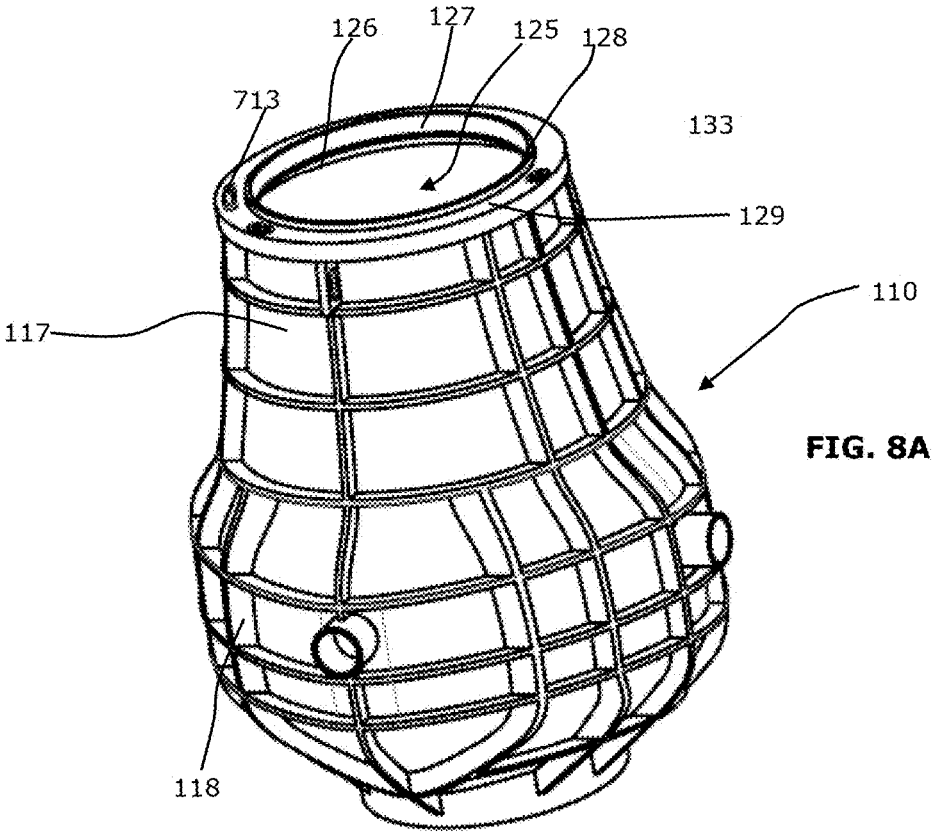
FIG. 8A is a side perspective view of the tank of FIG. 7A.

FIGS. 7B and 8A show the open top of the tank body 110 and the top opening 125 when it is not occluded by the lid 150. At spaced locations around a flanged top rim 129 of the tank body 110 are a plurality (e.g. 2, 3 or 4) of anchor plates 133 to receive fasteners 131 (FIG. 5) to attach the lid 150 to the tank body 110. A locating feature 713, such as a raised rib, may be formed on the top rim 129 to help position the lower or upper parts 154, 152 of the lid 150 in a specific orientation relative to the tank body 110.

Figure 8B:
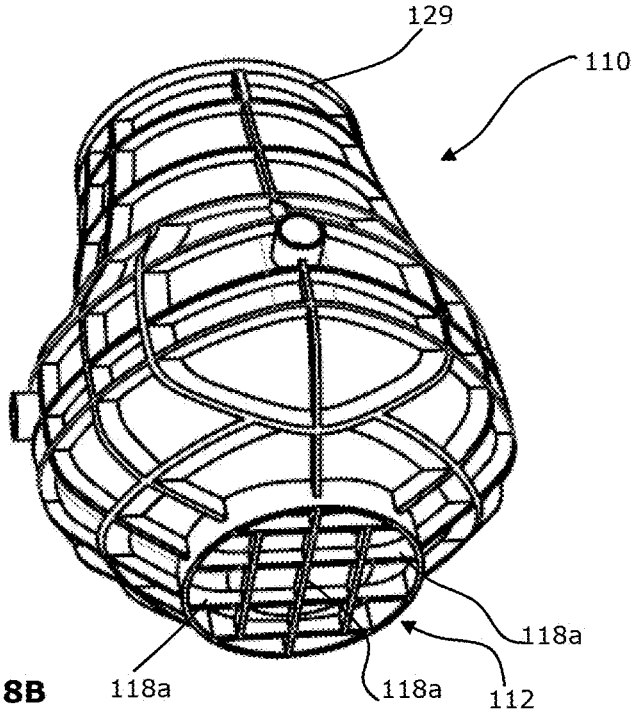
FIG. 8B is a bottom perspective view of the tank body of FIG. 7A.

FIG. 8B shows the base 112 of the tank body 110. The base 112 has a downwardly projected flange or rim that has an even, lower edge upon which the tank 100 can rest and that is sufficiently strong to bear the weight of the tank body 110, at least when it is empty of fluid. The flange or rim of the base 112 may be reinforced by interior ribs 118*a*, as can be seen in FIG. 8B.

Referring generally to FIGS. 6 and 11 to 19, the tank lid 150 is shown in further detail. The lid 150 comprises the upper part 152 and the lower part 154. Together, the upper and lower lid parts 152, 154 define a lid chamber 672 for receiving a pump controller 610 for controlling operation of a pressure sewer pump to be located inside the tank volume 140. The lid chamber 672 may be defined by a lower surface 682, interior side wall surfaces 517 and optionally also one or more dividing sections 675.

In FIG. 6, pressure sewer tank 100 is shown with the upper lid part 152 separated from the lower lid part 154. FIG. 6 shows an under side of the top lid part 152, with fasteners 131 projecting through apertures 132 in the top lid walls 416, 412, as shown in FIG. 5. The fasteners 131 are receivable in anchor plates 133, shown positioned at circumferentially spaced locations around the top rim 129 of the tank body 110.

FIG. 6 shows the lower lid part 154 seated on top of the tank body 110 so as to generally occlude the top opening 125. In order to occlude the top opening 125, the lower lid part 154 can be manually lowered down so that an angled outer wall 516 of the lower lid part 154 slides through the aperture defined by sloping wall 127 until outer rim parts 510 of the lower lid part 154 rest on top of the flat annular section of top rim 129 and the raised rim 128 is received within a rim recess 511 defined in between the outer rim portions 510 and the angled outer wall 516 (best seen in FIG. 12). In this position, the angled outer wall 516 of the lower rim part 154 may rest against the sloped wall 127 of the top rim 129.

Outer rim portions 510 of the lower lid part 154 may have recessed areas 1130 formed at spaced intervals around the rim circumference. The recessed areas 1130 are shaped to avoid occluding the fastener anchors 133, so that fasteners 131 can extend from the lid top portion 152 through to the fastener anchors 133 without being blocked by the outer rim 510. In order to assist in achieving correct alignment of the lower lid part 154 in the top opening 125, complementary positioning formations are provided on a bottom face of the top rim 510 and on an upper face of the rim 129. For example, a raised portion 713 (FIG. 7A) may be provided on top rim 129 and a correspondingly shaped recessed portion 1513 may be provided on the lower face of outer rim 510 (best seen in FIGS. 15C and 15E).

It can be seen from FIG. 6 that the lower lid part 154 has two upwardly projecting handle portions 665 positioned on diametrically opposite parts of the lower lid part 154. Handle portions 665 define apertures therethrough or alternatively define gripping rims to facilitate manual gripping of the handle portions 665. These handle portions 665 can be used to assist in manually placing and removing the lower lid part 154 into and out of the top opening 125. The upper lid part 152 has complementary handle recesses 654 that are sized to receive the handle portions 665 when the upper lid part 152 is fastened on to the lower lid part 154 in normal use.

FIG. 6 shows a pump controller 610 present within a first cavity portion 672 of the lid cavity defined between the upper and lower lid parts 152, 154. The lower lid part 154 further comprises a separator 675, for example in the form of a dividing wall, to separate the first cavity portion 672 that houses the pump controller 610 from a second cavity portion 674 that houses the battery (e.g. power supply 611 in FIG. 21). The separator 675 is configured to spatially separate the pump controller 610 from the battery, while allowing space between the top of the separator 675 and the adjacent bottom wall 651 of the upper lid part 152 for one or more electrical cables to pass between the battery and the pump controller 610.

Further, the lid cavity defined between the upper and lower lid parts 152, 154 allows space for passage of cables extending from the pump controller 610 to a plurality of sealing glands 664 disposed in the lower lid part 154 that permit passage of electrical conductors from the lid cavity into the interior tank volume 140. Such electrical conductors passing into (or out of) the interior tank volume 140 from the lid cavity permits the transmission of control signals from the pump controller 610 to the pump (e.g. pump 2080 in FIG. 20) and for the pump controller 610 to receive output signals from one or more sensor devices located within the internal tank volume 140. Such sensor devices may include one or more level sensors, for example, optionally including one or more pressure sensors.

One or more of the sealing glands 664 may be positioned in a bottom wall of the part of the lower lid part 154 that defines the first cavity portion 672, so that there is at least one sealing gland close to the position of the pump controller 610. One or more other sealing glands 664 may be positioned on a gland shelf 676 that is not significantly recessed downwardly from the level of the outer rim 510. The gland shelf 676 may comprise one, two, or three actively used sealing glands 664 but may have up to a set number, such as four sealing gland positions 662. Any unused sealing gland positions 662 are to be blocked. The lid chamber is configured to be substantially air tight against influx of gas from the tank volume 140.

The upper lid part 152 may define a third internal cavity portion 678 (seen best in FIG. 13) that generally overlies the gland shelf 676 and allows space for flexible cables to run from the nearby first cavity portion 672 into the relevant sealing gland 664, while allowing space for the electrical cables to arc or bend or coil somewhat before passing through the sealing gland 664.

In some embodiments, the upper lid part 152 may be formed by rotational moulding, for example. In such embodiments, one or more stiffening material bridges may be formed by recessed areas 653 extending between the lower inside surface 651 of the upper lid part 152 and the top wall 416. Such material bridges may be formed in a spaced array to provide a suitable stiffening effect. In other embodiments, the recessed areas 653 may not form part of material bridges and may instead serve to provide internal support surfaces to hinder the top wall 420 from being deflected downwardly by more than a small amount, such as a few millimetres.

The upper lid part 152 may define at least one, and preferably multiple, pressure relief channels 130 arranged to provide a passage for relief of pressure build up from inside the lid cavity to the outside environment, for example in case there is a build-up of pressurised gas that has leaked into the lid cavity from inside the tank volume 140. Such pressure relief channels 130 may be disposed at spaced radial locations about the inner annular wall 412*a*. Such channels may be formed by recessed slots formed in annular wall 412*a*. Additionally or alternatively, the pressure relief channels 130 can be provided by recessed slots formed in the upper surface of one or more of the rim portions 510 of lower lid part 154.

In some embodiments, the lower lid part 154 is formed by rotational moulding and may (like upper lid part 152) comprise strengthening material bridges formed by recessed areas 553 that extend upwardly from a bottom wall 518 of the lower lid part 154 up toward a floor section that partly defines the first cavity portion 672 or the second cavity portion 674. Alternatively, the recessed areas 553 may not form part of material bridges and may simply assist to provide a structural support against downward deflection.

The bottom wall 518 of the lower lid part 154 is connected to and continuous with the angled side walls 516 and is arranged to be positioned below the level of the top rim 129 when the lower lid part 154 is received through the top cavity 125 and is seated in a normal use position thereon. The lower lid part 154 therefore takes up some of the space inside the tank body 110 towards the top end thereof. However, such space inside the top of the tank body 110 is normally considered to be "head space" in which it is not desirable to have fluid present because it would indicate an overflow or extreme high level condition.

Figure 12:
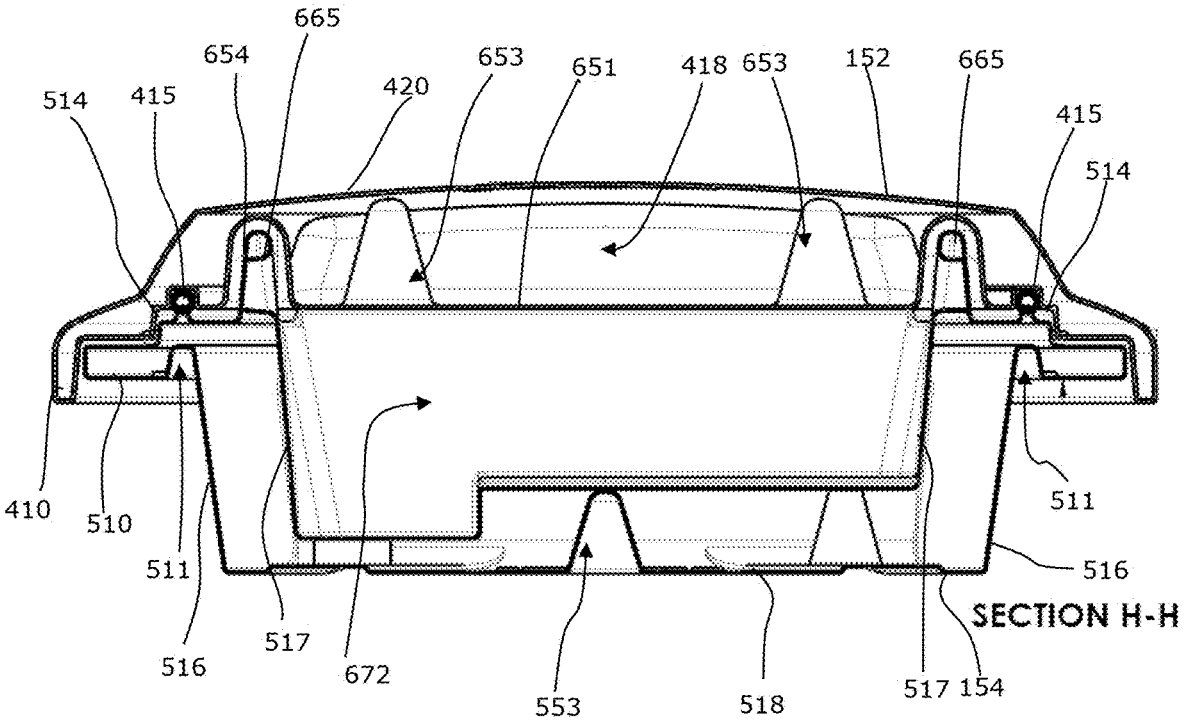
FIG. 12 is a cross-sectional view of the lid assembly taken along line H-H shown in FIG. 11.
Figure 13:
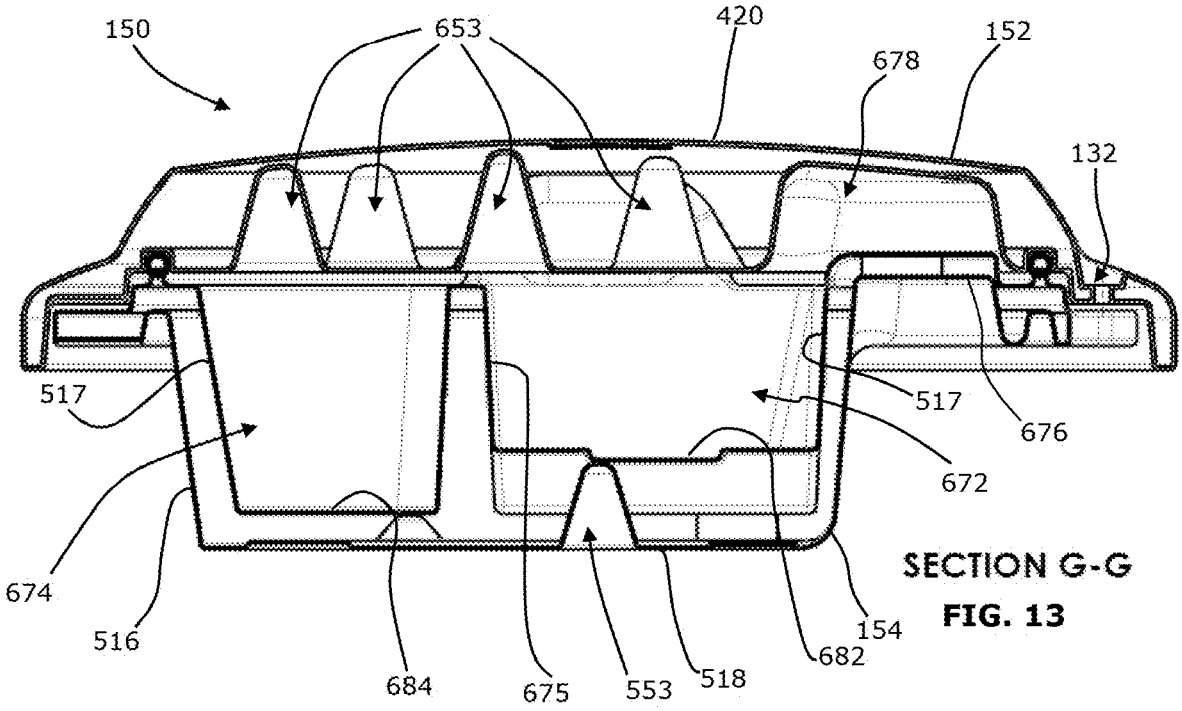
FIG. 13 is a different side cross-sectional view of the lid assembly, taken along line G-G shown in FIG. 11, where the cross-sectional view of FIG. 13 is generally perpendicular to the cross-sectional view of FIG. 12.
Figure 14:
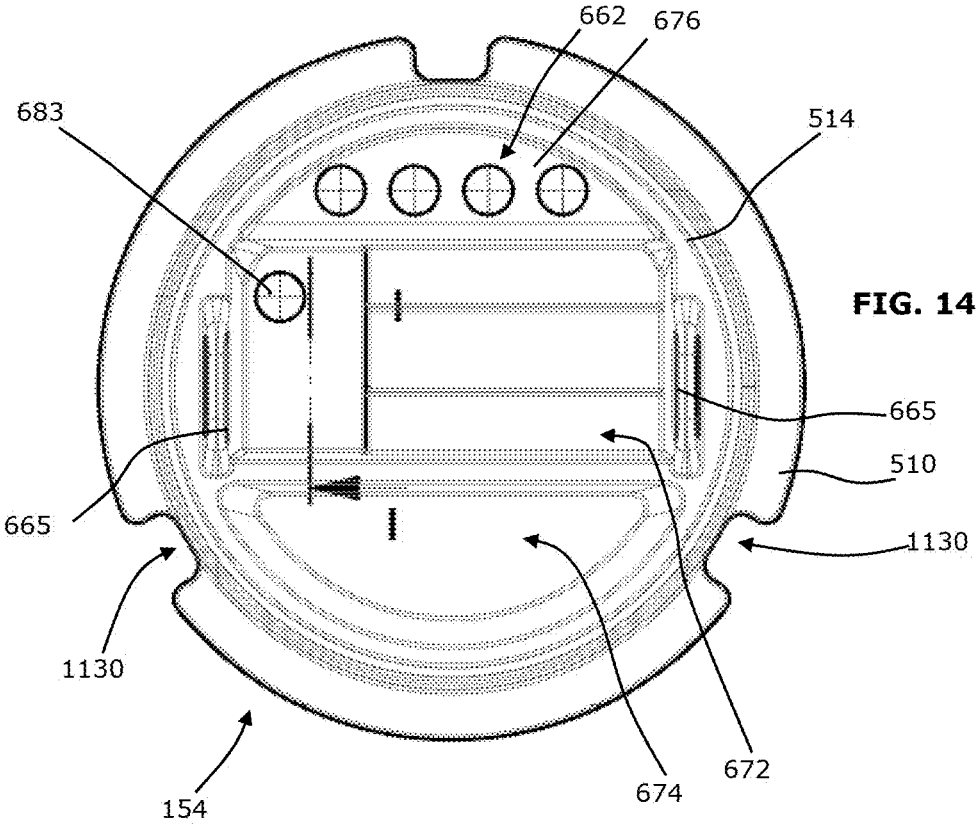
FIG. 14 is a plan view of a lower lid part of the lid assembly.
Figure 15I:
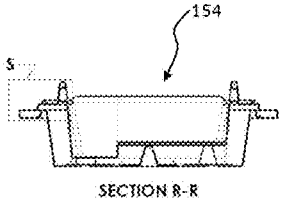
FIG. 15I is a side cross-sectional view of the lower lid part of FIG. 15A, taken along line R-R shown in FIG. 15A.
Figure 15A:
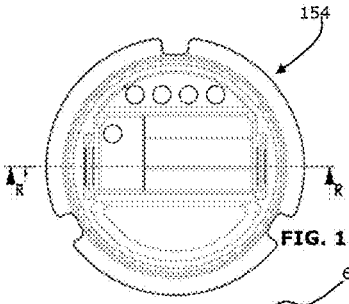
FIG. 15A is a plan view of the lower lid part, similar to the view shown in FIG. 14.
Figure 15B:
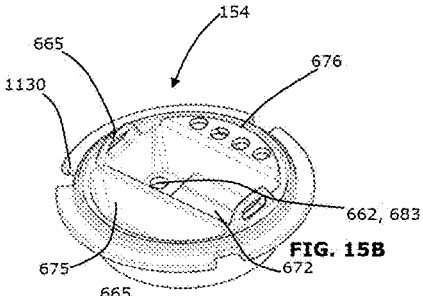
FIG. 15B is a top perspective view of the lower lid part of FIG. 15A.
Figure 15F:
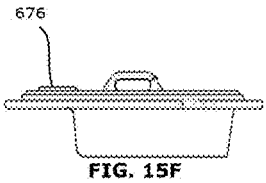
FIG. 15F is a left side view of the lower lid part of FIG. 15A.
Figure 15D:
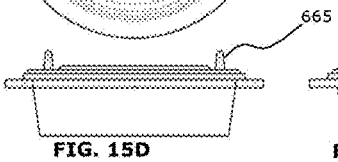
FIG. 15D is an end view of the lower lid part of FIG. 15A.
Figure 15G:
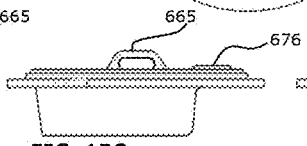
FIG. 15G is a right side view of the lower lid part of FIG. 15A.
Figure 15H:
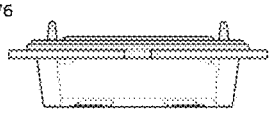
FIG. 15H is a front end view of the lower lid part of FIG. 15A (i.e., an opposite end view to FIG. 15D)
Figure 16:
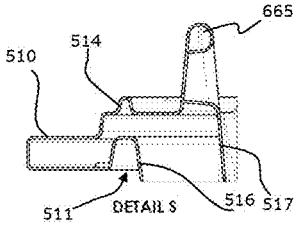
FIG. 16 is a close up detailed view of a rim and flange region of the lower lid part shown by section S in FIG. 15I.
Figure 15E:
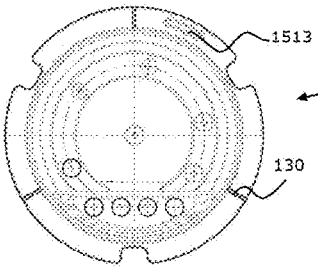
FIG. 15E is a bottom view of the lower lid part of FIG. 15A.
Figure 15C:
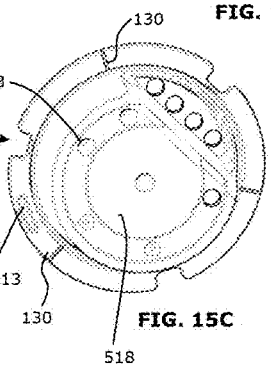
FIG. 15C is a bottom perspective view of the lower lid part of FIG. 15A.
Figures 17A, 17B, 17C, 17D, 17E, 17G, 17H, 18, 19:
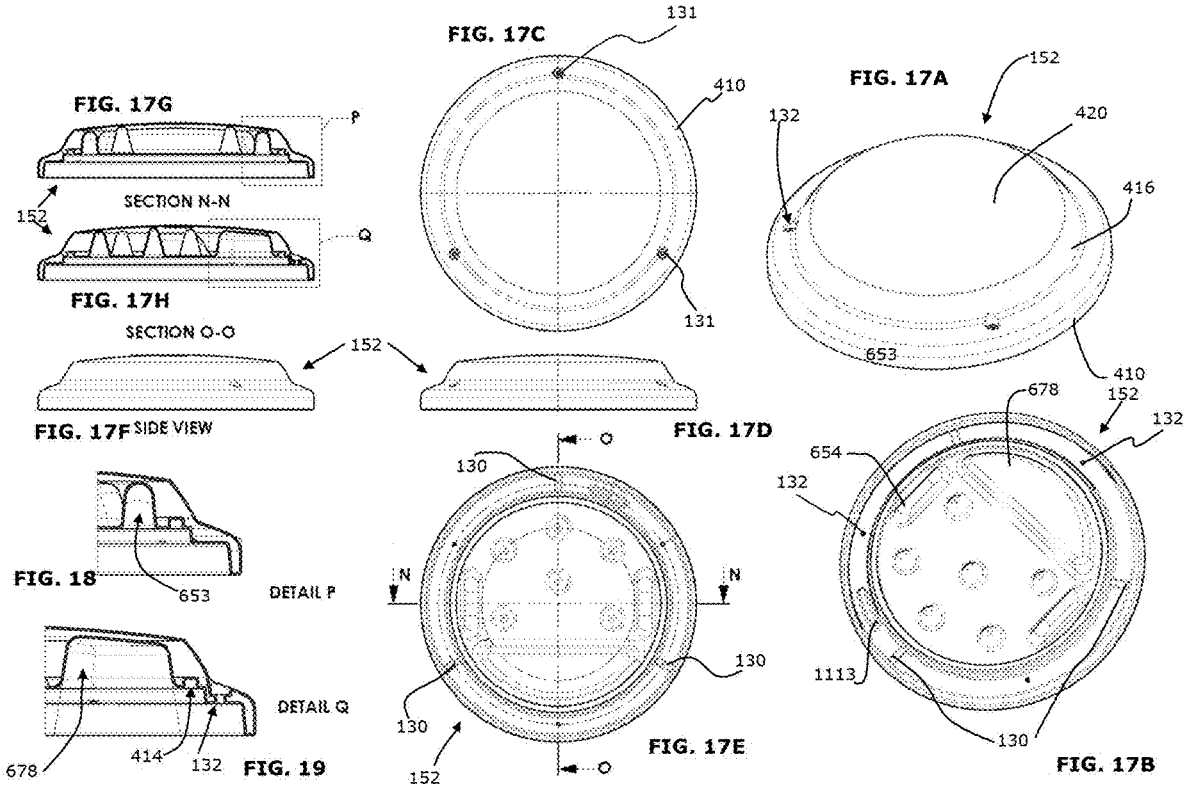
FIG. 17A is a top perspective view of an upper lid part of the lid assembly.
FIG. 17B is a bottom perspective view of the upper lid part of FIG. 17A.
FIG. 17C is a plan view of the upper lid part of FIG. 17A.
FIG. 17D is a front end view of the upper lid part of FIG. 17A.
FIG. 17E is an underside view of the upper lid part of FIG. 17A.
FIG. 17G is a side cross-sectional view of the upper lid part, taken along line N-N shown in FIG. 17E.
FIG. 17H is a further side cross-sectional view of the upper lid part, taken along line O-O shown in FIG. 17E.
FIG. 18 is a close up view of an outer edge of the upper lid part, shown as detail P in FIG. 17G.
FIG. 19 is a close up detail view of another edge region of the upper lid part, shown as detail Q in FIG. 17H.

FIGS. 12 and 13 illustrate the lid 150 in a closed position, with the upper lid part 152 supported on top of the lower lid part 154. In the closed position, a raised peripheral rim 514 (positioned circumferentially inwardly of the outer rim 510) abuts and is sealingly engaged with a sealing ring 415 received in receiving recess 414. In the closed position, the handle portions 665 are received in handles recesses 654 and the lower annular wall 412*a* of the upper lid part 152 overlies the flat outer annular surface of the top rim 129. Receipt of the handle portions 665 in the handle recesses 654 serve to generally align the upper and lower lid parts 152, 154 to allow the fasteners 131 to be secured in place and thereby removably affix the upper lid part 152 to the lower lid part 154 and define the lid chamber therebetween.

With reference to FIGS. 23 to 31, in one embodiment, the lid assembly 150 has a reduced diameter to minimise the space required and to improve compatibility with nature-strip and footpath installations. In particular, the diameter of the upper lid part 152 may be reduced to approximately 660 mm and corresponding reduction to the diameter of the lower lid part 154 may also be made. In addition, ribs 421 may be provided on the upper lid part 152 to provide strength while reducing the materials required. In one configuration, the lifting handle portions 665 are formed within the wall of the lower lid part 154 to further reduce the size of the lid assembly 150. An alignment feature 666 may be provided to an outer wall of the lower lid part 154 to assist with the alignment of the lid assembly 150 with the tank body 110 during installation.

Figure 21:
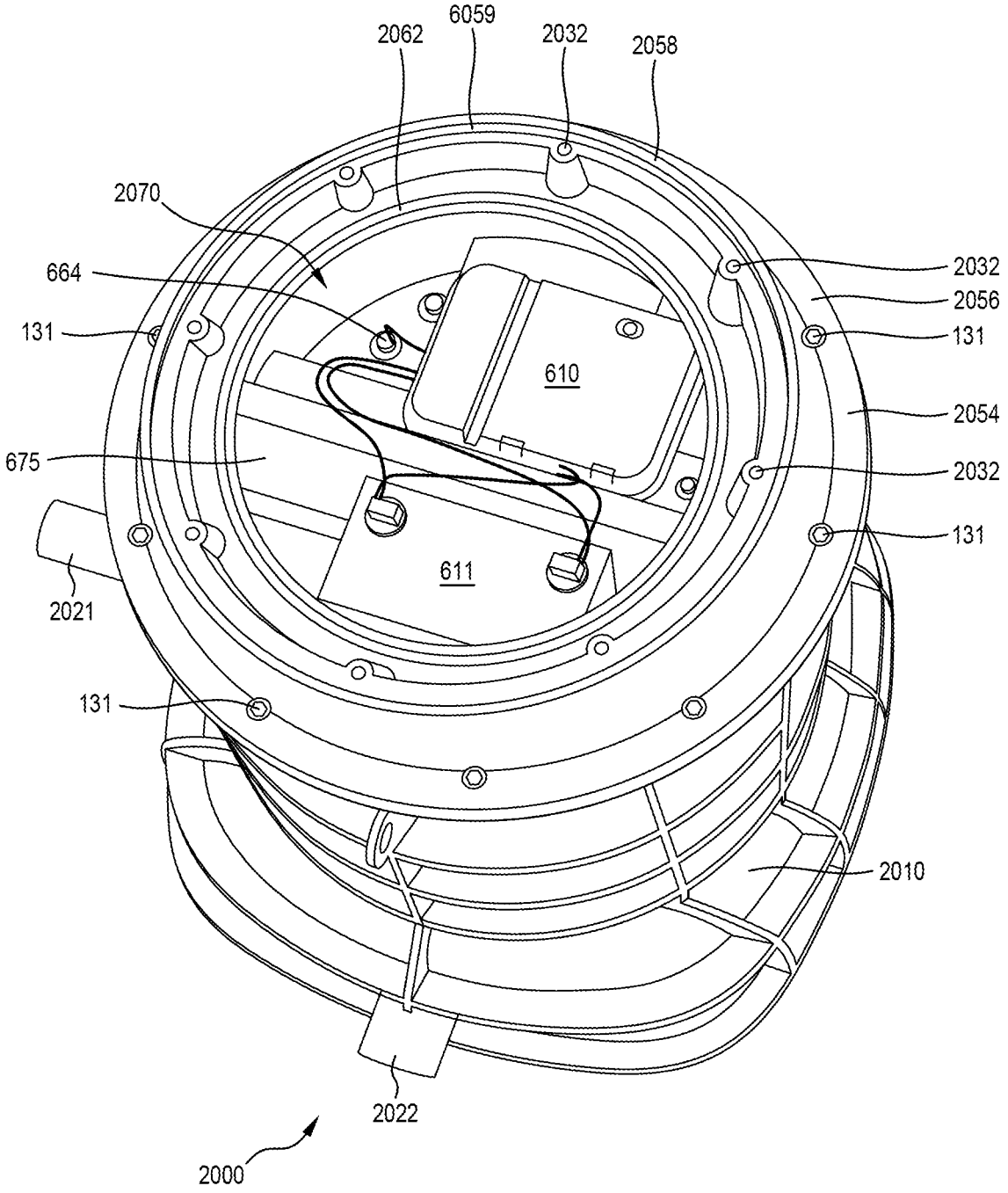
FIG. 21 is a perspective view of a tank installation according to some embodiments, illustrating how a pump controller can be positioned inside the lid assembly, together with an external power source for the pump controller.
Figure 22:
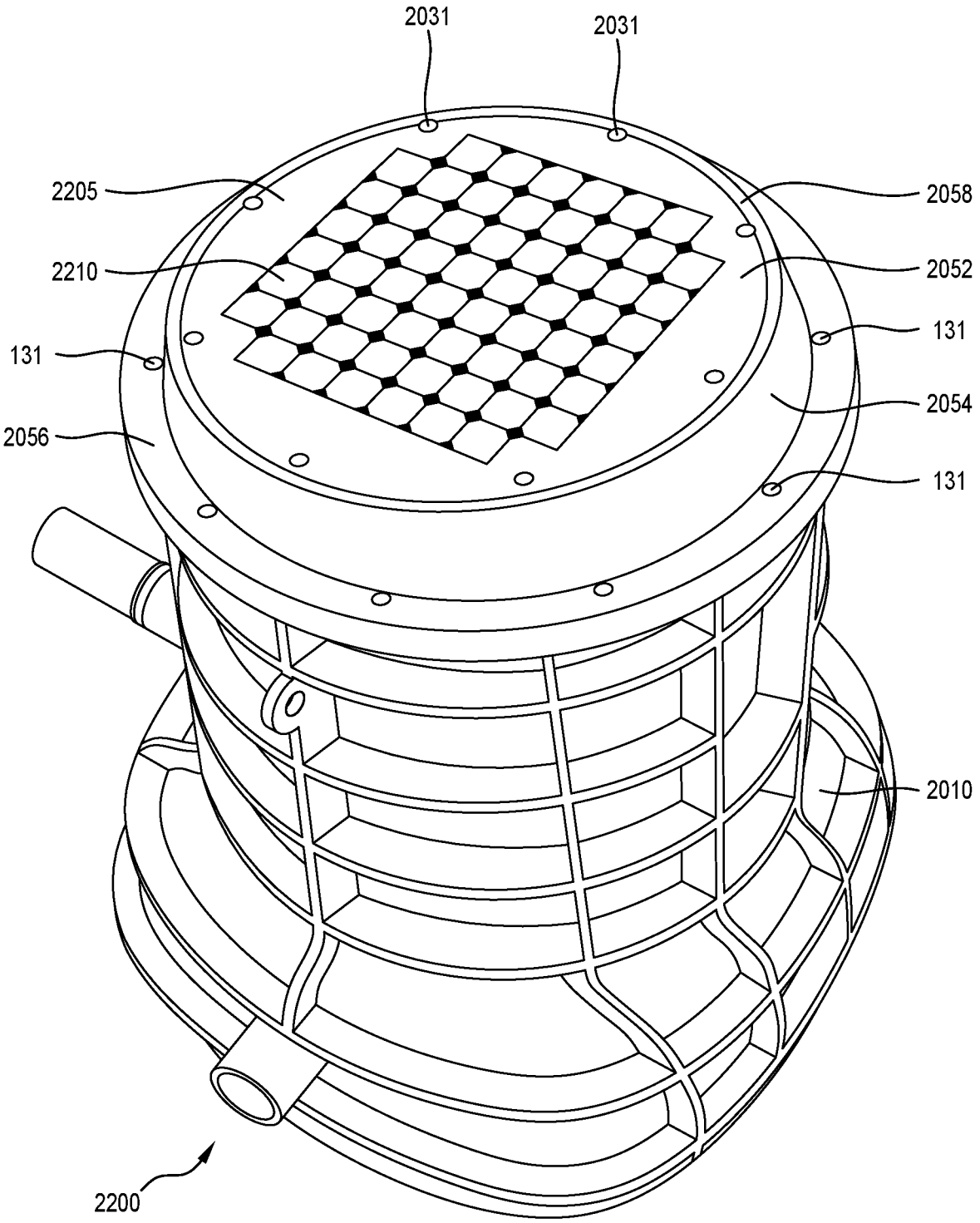
FIG. 22 is a top perspective view of embodiments of the pressure sewer tank installation, where a power source in the form of a solar panel is disposed on a upper face of the lid.
Figure 23A:
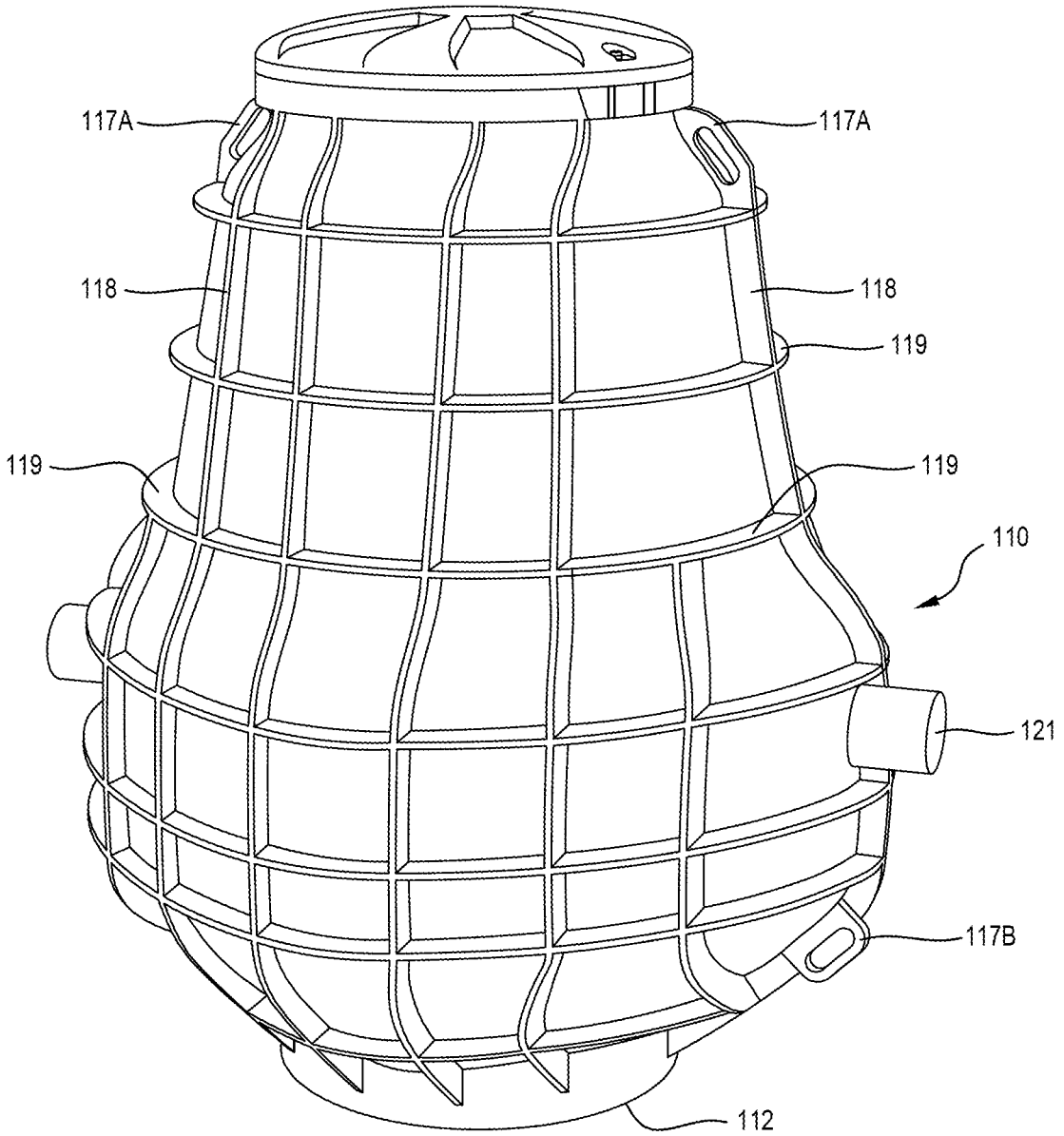
FIG. 23A is a rendered side perspective view of a pressure sewer tank assembly according to another embodiment of the present invention.
Figure 23B:
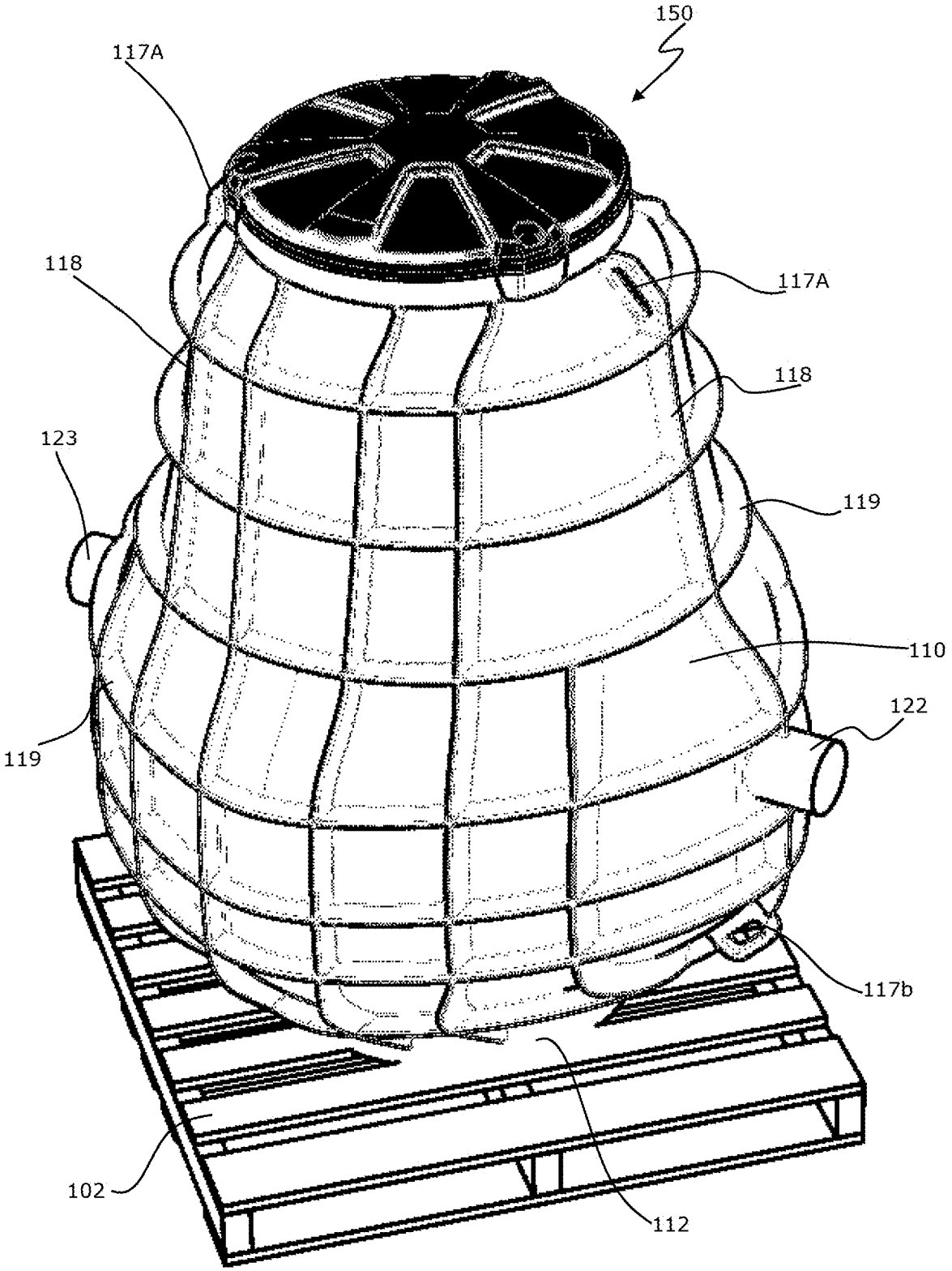
FIG. 23B is a top perspective view of a pressure sewer tank assembly of FIG. 23A, shown positioned on a standard transport pallet for reference.
Figure 24:
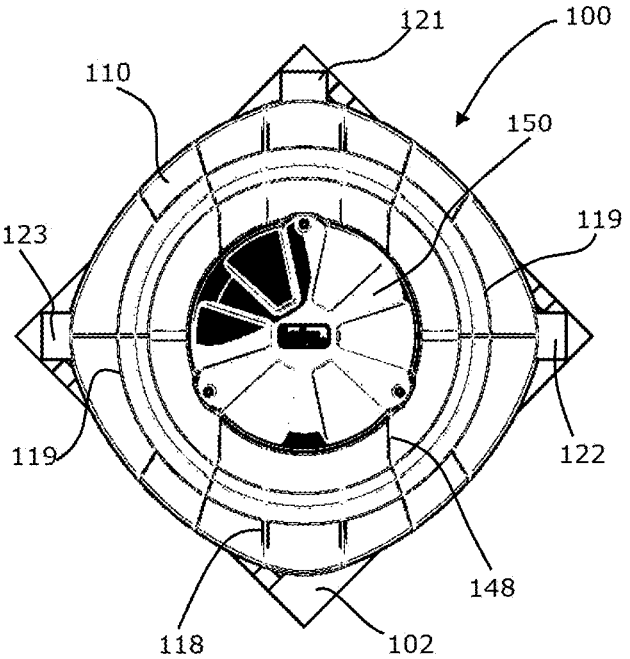
FIG. 24 is a plan view of the pressure sewer tank assembly of FIG. 23.
Figure 25:
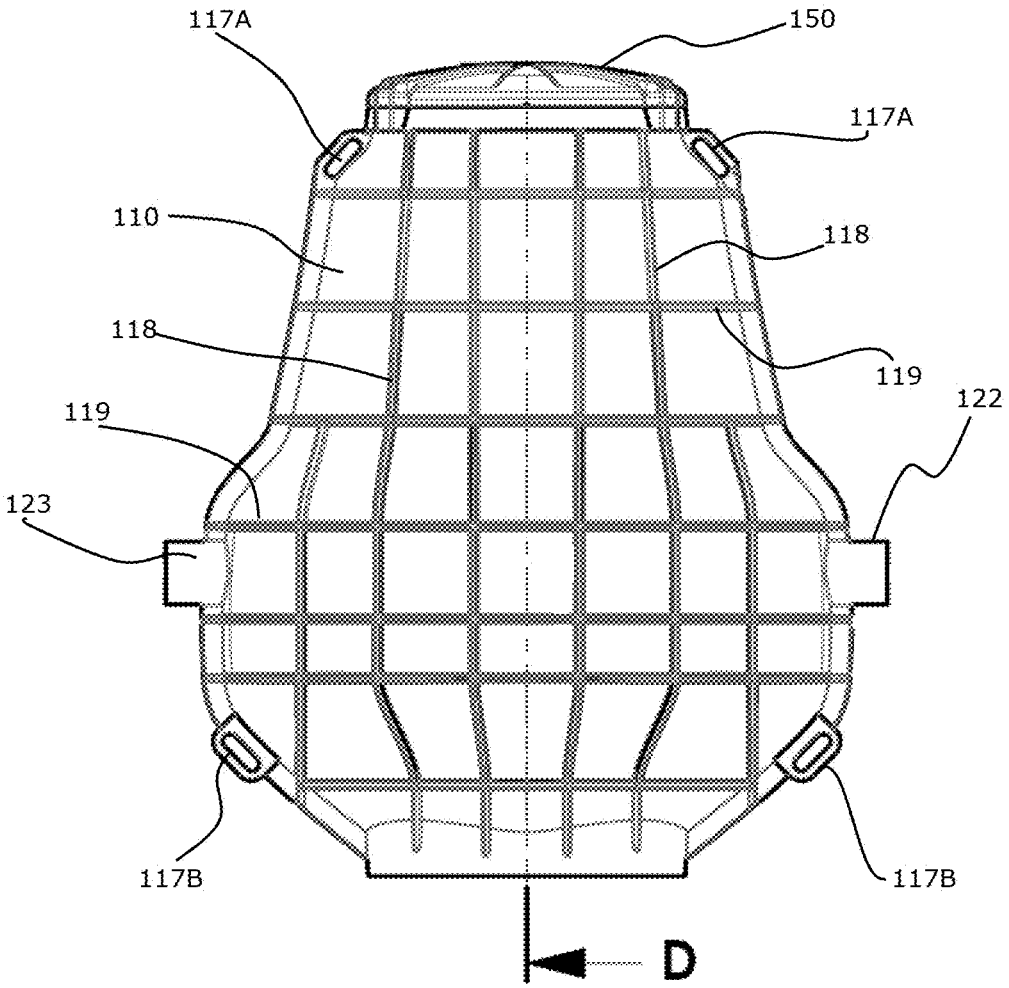
FIG. 25 is a front view of the pressure sewer tank assembly of FIG. 23.

Referring now to FIGS. 20, 21 and 22, further embodiments of a pressure sewer system 2000, 2200 are shown and described in further detail. Pressure sewer system 2000 is functionally similar in many respects to pressure sewer system 100. Specifically, the pressure sewer system 2000 comprises a two part lid 2050 that occludes the top opening of the tank body 2010. A lower part 2054 of the lid 2050 sits on the top rim of the tank body 2010 and occludes (and partly hangs down through) the top opening. Additionally, pressure sewer system 2000 is similar to system 100 in that it is designed to include space for and house a pump controller 610 and a power source 611 (such as a rechargeable battery) within a lid chamber 2070 that is defined by an internal space of the two part lid 2050. The upper lid part 2052 of the two part lid 2050 is arranged to sealingly couple to the lower lid part 2054 in order to avoid ingress of unwanted material into the lid chamber 2070.

The pump controller 6120 of pressure sewer system 2000 is arranged to control operation of a pump 2080 and to receive inputs from a fluid level sensor 2088 positioned within the internal tank volume 2040. The pump 2080 is positioned toward a base 2012 of the tank body 2010 to pump fluid from regions close to the base 2012 out of a fluid outlet 2081. The tank body 2010 may define one or multiple fluid inlets 2021, 2022.

The power supply 611 for the pump controller 610 may also supply power to the pump 2080 and may be configured as a DC (direct current) power supply, for example. Cabling 612 may be provided within the lid chamber 2070 and the tank volume 2040 in order to provide power to the pump controller 610 and pump 2080, as well as to allow pump controller 610 to receive sensor output signals from fluid level sensors 2088 and status or feedback signals from the pump 2080.

Pressure sewer system 2000 may also be arranged to receive power from a renewable power source. For example, as shown in FIG. 20, the power supply 611 may receive electrical energy via a conductor cable 2092 that is coupled to a solar cell array 2095. The solar cell array may be supported by a suitable support structure 2091 to permit appropriate positioning of the solar cell array 2095 to best receive solar energy in view of the local environment.

Pressure sewer system 2200 is the same as pressure sewer system 2000, but has a solar cell array 2210 housed in the upper lid part 2052, rather than being supported by a separate structure 2091. The energy output of the solar cell array 2210 is provided to the power supply 611 to keep the power supply 611 charged as much as possible. As shown in FIG. 22, additional fasteners 2031 may be applied to securely retain the solar cell array 2210 in place and hinder theft or vandalism thereof. For example, fasteners 2031 may assist in holding down a clear plastic sheet that covers the solar cell array 2210. The lower lid part 2054 is secured to the top rim of the tank body 2010 by fasteners 131 that are passed through apertures in a flanged section 2056 of the lower lid part 2054 and received in suitable anchoring structure in the top rim of the tank body 2010.

As is most evident in FIG. 21, the lower lid part 2054 defines an upper rim 2058 within which is received the upper lid part 2052. The upper rim 2058 has a sealing ring 2059 disposed radially inwardly thereof to assist in seating and sealing with the upper lid part 2052. Inwardly and downwardly of the upper rim 2058, the lower lid part 2054 has an inwardly projecting annular flange 2062 that define a large opening through which the pump controller 610 and power supply 611 can be accessed. This access opening is configured to be large enough to enable manual access to the various sealing glands and cables within the lid chamber 2070 to allow for ease of installation and commissioning. FIG. 21 also shows anchor portions 2032 formed in a circumferential array adjacent the upper rim 2058 of lower lid portion 2054. Anchor portions 2032 are for receiving fasteners 2031 for affixing the upper lid portion 2052 (whether that upper lid portion 2052 comprises the solar cell array 2210 or otherwise).

It is to be understood that the weight of the tank may be modified to accommodate different applications. In some embodiments, the weight of the tank is approximately 70 kg to improve portability and ease of installation while reducing transportation costs.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A storage tank, comprising:

a neck portion having an opening, the neck portion having side walls which define a first storage volume, wherein the neck portion has a substantially frustoconical shape;

a body portion connected to, and located below, the neck portion, the body portion comprising two pairs of opposing side walls and a base which define a second storage volume, wherein each wall of the two pairs of opposing side walls bulges radially outwardly forming the perimeter of the body portion, and wherein the second storage volume is greater than the first storage volume;

ribs projecting generally radially from the side walls of the neck portion and/or the side walls of the body portion; and a substantially round middle section positioned between, and connecting, the neck portion and the body portion, wherein the middle section comprises an outwardly tapering transition section that is angled outwardly about the circumference of the middle section, at between about 30 degrees and about 60 degrees to the vertical.

2. A storage tank according to claim 1, wherein the neck portion is configured with a substantially circular cross-section in the horizontal plane.

3. A storage tank according to claim 1, wherein the body portion has a maximum lateral width dimension that is between about 20% and about 50% larger than a maximum lateral width dimension of the opening.

4. The storage tank of claim 1, wherein the neck portion tapers outwardly in a direction from the opening toward the body portion.

5. The storage tank of any one of claim 1, wherein a combined volumetric capacity of a lower end of the body portion is at least 50% greater than a remaining volumetric capacity of the storage tank.

6. The storage tank of any one of claim 1, wherein the opening comprises an annular flange having a raised inner rim that stands proud of a radially outer part of the annular flange.

7. The storage tank of any one of claim 1, wherein the opening comprises a mouth, wherein the mouth has an inwardly tapered wall that tapers inwardly in a downward direction.

8. The storage tank of claim 7, wherein the opening comprises an annular flange having a raised inner rim that stands proud of a radially outer part of the annular flange, wherein the inwardly tapered wall has a bottom edge extending below the raised inner rim.

9. The storage tank of claim 8, wherein the inwardly tapered wall is defined in part by the raised inner rim.

10. The storage tank of claim 1, further comprising a plurality of horizontal and vertical exterior ribs extending outwardly from the side walls to provide increased structural strength to the body portion.

11. A method of installing a pressure sewer tank, comprising:

positioning the storage tank as claimed in claim 1 in relation to a ground surface;

positioning a pressure sewer pump in the storage tank;

coupling an inlet conduit to an inlet of the storage tank and coupling an outlet of the pressure sewer pump to an outlet of the storage tank;

positioning a two-part lid over a top opening of the storage tank to occlude the top opening, wherein the two-part lid comprises a first lid part to occlude the top opening and a second lid part to cover over the first lid part, and wherein the first and second lid parts define a chamber therebetween that is sized to receive a pump controller.

12. The method of claim 11, further comprising positioning the pump controller in the chamber and electrically coupling the pump controller to the pressure sewer pump to allow the pump controller to control operation of the pressure sewer pump.

13. The method of claim 11, wherein the chamber of the two-part lid defines a first section to receive the pump controller and a second section spaced from the first section and sized to receive a battery that is configured to supply power to the pump controller and to the pressure sewer pump, wherein the method further comprises electrically coupling the battery to the pump controller to supply power from the battery to the pump controller.

14. The method of claim 13, further comprising electrically coupling a renewable energy source to the battery.

15. The method of claim 11, further comprising securing the two-part lid to the storage tank to substantially close the top opening.

16. The method of claim 15, wherein the securing comprises fastening the second lid part to an upper rim of the storage tank.

17. A method of assembling a pressure sewer tank, comprising:

positioning a two-part lid over a top opening of the storage tank as claimed in claim 1 of a pressure sewer tank to occlude a top opening, wherein the two-part lid comprises a first lid part to occlude the top opening and a second lid part to cover over the first lid part, and wherein the first and second lid parts define a chamber therebetween that is sized to receive a pump controller; and securing the two-part lid to the storage tank to substantially close the top opening.

* * * * *